US010192390B2

(12) United States Patent
Hughes et al.

(10) Patent No.: US 10,192,390 B2
(45) **Date of Patent: *Jan. 29, 2019**

(54) GAMING SYSTEM, GAMING DEVICE, AND METHOD FOR ENABLING A PLAYER TO SELECT VOLATILITY USING GAME SYMBOLS

(71) Applicant: IGT, Las Vegas, NV (US)

(72) Inventors: William K. Hughes, Reno, NV (US); Eric S. Boese, Duluth, GA (US)

(73) Assignee: IGT, Las Vegas, NV (US)

( * ) Notice: Subject to any disclaimer, the term of this patent is extended or adjusted under 35 U.S.C. 154(b) by 8 days.

This patent is subject to a terminal disclaimer.

(21) Appl. No.: 15/057,482

(22) Filed: Mar. 1, 2016

(65) Prior Publication Data

US 2016/0180641 A1 Jun. 23, 2016

Related U.S. Application Data

(63) Continuation of application No. 14/515,212, filed on Oct. 15, 2014, now Pat. No. 9,299,220, which is a (Continued)

(51) Int. Cl.
*G07F 17/32* (2006.01)
*G07F 17/34* (2006.01)

(52) U.S. Cl.
CPC ..... *G07F 17/3213* (2013.01); *G07F 17/3262* (2013.01); *G07F 17/3265* (2013.01); *G07F 17/3267* (2013.01); *G07F 17/34* (2013.01)

(58) Field of Classification Search
USPC ..... 463/19, 20, 21, 25
See application file for complete search history.

(56) References Cited

U.S. PATENT DOCUMENTS 2,812,182 A 11/1957 James
3,834,712 A 9/1974 Cox
(Continued)

FOREIGN PATENT DOCUMENTS

EP 0 464 935 1/1992
EP 0 945 837 9/1999
(Continued)

OTHER PUBLICATIONS

18 Reeler, Article, written by IGT, published in 2002.
(Continued)

*Primary Examiner* — Dmitry Suhol
*Assistant Examiner* — Brandon Gray
(74) *Attorney, Agent, or Firm* — Neal, Gerber & Eisenberg LLP

(57) ABSTRACT

Various embodiments of the gaming system, gaming device, and gaming method disclosed herein provide a primary game and a free activation bonus sequence, wherein the gaming system enables the player to select one or more of a plurality of different volatility options for use in the free activation bonus sequence. Each option is associated with a different number of free activations and a different pool of symbols or different symbol functionality. The gaming system provides this variation in the pool of symbols or symbol functionality in various embodiments by enabling the player to replace one or more symbols of a pool or set of symbols of the primary game (i.e., the primary set of symbols) with the symbol associated with a player selected option. The symbols of this modified set of symbols (i.e., the secondary set of symbols) are used in the free activation bonus sequence).

31 Claims, 19 Drawing Sheets

Related U.S. Application Data continuation of application No. 13/954,515, filed on Jul. 30, 2013, now Pat. No. 8,876,590, which is a continuation of application No. 12/271,278, filed on Nov. 14, 2008, now Pat. No. 8,506,380.

(56) References Cited

U.S. PATENT DOCUMENTS

| | | | |
|---|---|---|---|
| 4,093,215 | A | 6/1978 | Ballard |
| 4,184,683 | A | 1/1980 | Hooker |
| 4,200,291 | A | 4/1980 | Hooker |
| 4,335,809 | A | 6/1982 | Wain |
| 4,339,798 | A | 7/1982 | Hedges et al. |
| 4,344,345 | A | 8/1982 | Sano |
| 4,363,482 | A | 12/1982 | Goldfarb |
| 4,389,048 | A | 6/1983 | Burgess |
| RE31,441 | E | 11/1983 | Nutting et al. |
| 4,494,197 | A | 1/1985 | Troy et al. |
| 4,496,149 | A | 1/1985 | Schwartzberg |
| 4,506,890 | A | 3/1985 | Murry |
| 4,517,656 | A | 5/1985 | Solimeno et al. |
| 4,570,934 | A | 2/1986 | Smyth |
| 4,618,150 | A | 10/1986 | Kimura |
| 4,648,600 | A | 3/1987 | Olliges |
| 4,695,053 | A | 9/1987 | Vazquez, Jr. et al. |
| 4,732,386 | A | 3/1988 | Rayfiel |
| 4,836,546 | A | 6/1989 | Dire et al. |
| 4,837,728 | A | 6/1989 | Barrie et al. |
| 4,961,575 | A | 10/1990 | Perry |
| 5,031,914 | A | 7/1991 | Rosenthal |
| 5,043,889 | A | 8/1991 | Lucey et al. |
| 5,046,735 | A | 9/1991 | Hamano et al. |
| 5,067,712 | A | 11/1991 | Georgilas |
| 5,096,195 | A | 3/1992 | Gimmon |
| 5,179,517 | A | 1/1993 | Sarbin et al. |
| 5,205,555 | A | 4/1993 | Hamano |
| 5,242,163 | A | 9/1993 | Fulton |
| 5,259,616 | A | 11/1993 | Bergmann |
| 5,265,877 | A | 11/1993 | Boylan |
| 5,275,400 | A | 1/1994 | Weingardt et al. |
| 5,342,047 | A | 8/1994 | Heidel et al. |
| 5,342,049 | A | 8/1994 | Wichinsky et al. |
| 5,344,145 | A | 9/1994 | Chadwick et al. |
| 5,356,140 | A | 10/1994 | Dabrowski et al. |
| 5,390,938 | A | 2/1995 | Takeya |
| 5,393,057 | A | 2/1995 | Marnell, II |
| 5,393,061 | A | 2/1995 | Manship et al. |
| 5,397,125 | A | 3/1995 | Adams |
| 5,449,173 | A | 9/1995 | Thomas et al. |
| 5,580,053 | A | 12/1996 | Crouch |
| 5,611,535 | A | 3/1997 | Tiberio |
| 5,669,817 | A | 9/1997 | Tarantino |
| 5,687,968 | A | 11/1997 | Tarantino |
| 5,697,843 | A | 12/1997 | Manship et al. |
| 5,704,835 | A | 1/1998 | Dietz, II |
| 5,707,286 | A | 1/1998 | Carlson |
| 5,722,891 | A | 3/1998 | Inoue |
| 5,741,183 | A | 4/1998 | Acres et al. |
| 5,762,552 | A | 6/1998 | Vuong et al. |
| 5,766,074 | A | 6/1998 | Cannon et al. |
| 5,769,716 | A | 6/1998 | Saffari et al. |
| 5,772,509 | A | 6/1998 | Weiss |
| 5,788,240 | A | 8/1998 | Feinberg |
| 5,788,573 | A | 8/1998 | Baerlocher et al. |
| 5,807,172 | A | 9/1998 | Peichowiak |
| 5,820,459 | A | 10/1998 | Acres et al. |
| 5,823,873 | A | 10/1998 | Moody |
| 5,823,874 | A | 10/1998 | Adams |
| 5,833,538 | A | 11/1998 | Weiss |
| 5,836,817 | A | 11/1998 | Acres et al. |
| 5,848,932 | A | 12/1998 | Adams |
| 5,876,284 | A | 3/1999 | Acres et al. |
| 5,902,184 | A | 5/1999 | Bennett et al. |
| 5,910,048 | A | 6/1999 | Feinberg |
| 5,911,418 | A | 6/1999 | Adams |
| 5,951,397 | A | 9/1999 | Dickinson |
| 5,964,463 | A | 10/1999 | Moore, Jr. |
| 5,967,894 | A | 10/1999 | Kinoshita et al. |
| 5,976,016 | A | 11/1999 | Moody et al. |
| 5,980,384 | A | 11/1999 | Barrie |
| 5,984,779 | A | 11/1999 | Bridgeman et al. |
| 5,997,400 | A | 12/1999 | Seelig et al. |
| 5,997,401 | A | 12/1999 | Crawford |
| 6,015,346 | A | 1/2000 | Bennett |
| 6,033,307 | A | 3/2000 | Vancura |
| 6,056,642 | A | 5/2000 | Bennett |
| 6,059,289 | A | 5/2000 | Vancura |
| 6,059,658 | A | 5/2000 | Mangano et al. |
| 6,062,979 | A | 5/2000 | Inoue |
| 6,071,192 | A | 6/2000 | Weiss |
| 6,089,976 | A | 7/2000 | Schneider et al. |
| 6,089,977 | A | 7/2000 | Bennett |
| 6,089,978 | A | 7/2000 | Adams |
| 6,093,102 | A | 7/2000 | Bennett |
| 6,102,400 | A | 8/2000 | Scott et al. |
| 6,102,798 | A | 8/2000 | Bennett |
| 6,106,393 | A | 8/2000 | Sunaga et al. |
| 6,110,041 | A | 8/2000 | Walker et al. |
| 6,110,043 | A | 8/2000 | Olsen |
| 6,113,495 | A | 9/2000 | Walker |
| 6,120,031 | A | 9/2000 | Adams |
| 6,120,377 | A | 9/2000 | Mcginnis, Sr. et al. |
| 6,120,378 | A | 9/2000 | Moody et al. |
| 6,123,333 | A | 9/2000 | Mcginnis, Sr. et al. |
| 6,142,875 | A | 11/2000 | Kodachi et al. |
| 6,146,273 | A | 11/2000 | Olsen |
| 6,155,925 | A | 12/2000 | Giobbi et al. |
| 6,159,096 | A | 12/2000 | Yoseloff |
| 6,159,097 | A | 12/2000 | Gura |
| 6,159,098 | A | 12/2000 | Slomiany et al. |
| 6,162,122 | A | 12/2000 | Acres et al. |
| 6,173,955 | B1 | 1/2001 | Perrie et al. |
| 6,174,233 | B1 | 1/2001 | Sunaga et al. |
| 6,174,235 | B1 | 1/2001 | Walker et al. |
| 6,176,487 | B1 | 1/2001 | Eklund et al. |
| 6,190,255 | B1 | 2/2001 | Thomas et al. |
| 6,203,429 | B1 | 3/2001 | Demar et al. |
| 6,210,277 | B1 | 4/2001 | Stefan |
| 6,210,279 | B1 | 4/2001 | Dickinson |
| 6,213,876 | B1 | 4/2001 | Moore, Jr. |
| 6,217,448 | B1 | 4/2001 | Olsen |
| 6,227,971 | B1 | 5/2001 | Weiss |
| 6,251,013 | B1 | 6/2001 | Bennett |
| 6,254,481 | B1 | 7/2001 | Jaffe |
| 6,257,981 | B1 | 7/2001 | Acres et al. |
| 6,261,178 | B1 | 7/2001 | Bennett |
| 6,270,411 | B1 | 8/2001 | Gura et al. |
| 6,270,412 | B1 | 8/2001 | Crawford et al. |
| 6,290,600 | B1 | 9/2001 | Glasson |
| 6,306,034 | B1 | 10/2001 | Sakamoto et al. |
| 6,309,299 | B1 | 10/2001 | Weiss |
| 6,319,124 | B1 | 11/2001 | Baerlocher et al. |
| 6,319,125 | B1 | 11/2001 | Acres |
| 6,321,323 | B1 | 11/2001 | Nugroho et al. |
| 6,322,078 | B1 | 11/2001 | Adams |
| 6,331,143 | B1 | 12/2001 | Yoseloff |
| 6,334,814 | B1 | 1/2002 | Adams |
| 6,336,860 | B1 | 1/2002 | Webb |
| 6,346,043 | B1 | 2/2002 | Colin et al. |
| 6,364,767 | B1 | 4/2002 | Brossard et al. |
| 6,364,768 | B1 | 4/2002 | Acres et al. |
| 6,375,568 | B1 | 4/2002 | Roffman et al. |
| 6,375,569 | B1 | 4/2002 | Acres |
| 6,375,570 | B1 | 4/2002 | Poole |
| 6,394,902 | B1 | 5/2002 | Glavich et al. |
| 6,409,596 | B1 | 6/2002 | Hayashida et al. |
| 6,413,162 | B1 | 7/2002 | Baerlocher et al. |
| 6,419,579 | B1 | 7/2002 | Bennett |
| 6,443,837 | B1 | 9/2002 | Jaffe et al. |
| 6,450,883 | B1 | 9/2002 | O'halloran |
| RE37,885 | E | 10/2002 | Acres et al. |
| 6,491,584 | B2 | 12/2002 | Graham et al. |
| 6,494,454 | B2 | 12/2002 | Adams |
| 6,494,785 | B1 | 12/2002 | Gerrard et al. |

(56) References Cited

U.S. PATENT DOCUMENTS 6,517,432 B1 2/2003 Jaffe
6,520,855 B2 2/2003 DeMar et al.
6,533,658 B1 3/2003 Walker et al.
6,533,660 B2 3/2003 Seelig et al.
6,537,152 B2 3/2003 Seelig et al.
6,551,187 B1 4/2003 Jaffe
6,565,434 B1 5/2003 Acres
6,565,436 B1 5/2003 Baerlocher
6,581,935 B1 6/2003 Odom
6,585,591 B1 7/2003 Baerlocher et al.
6,592,457 B1 7/2003 Frohm et al.
6,599,192 B1 7/2003 Baerlocher et al.
6,602,136 B1 8/2003 Baerlocher et al.
6,604,740 B1 8/2003 Singer et al.
6,604,999 B2 8/2003 Ainsworth
6,605,001 B1 8/2003 Tarantino
6,616,142 B2 9/2003 Adams
6,632,139 B1 10/2003 Baerlocher
6,632,140 B2 10/2003 Berman et al.
6,634,943 B1 10/2003 Baerlocher
6,634,945 B2 10/2003 Glavich et al.
6,656,046 B1 12/2003 Yoseloff et al.
6,669,559 B1 12/2003 Baerlocher et al.
6,682,073 B2 1/2004 Bryant et al.
6,702,675 B2 3/2004 Poole et al.
6,731,313 B1 5/2004 Kamikow
6,739,971 B2 5/2004 Devaull
6,739,973 B1 5/2004 Lucchesi et al.
6,749,502 B2 6/2004 Baerlocher
6,755,738 B2 6/2004 Glasson et al.
6,769,985 B1 8/2004 Laakso et al.
6,780,109 B2 8/2004 Kaminkow
6,793,578 B2 9/2004 Luccesi et al.
6,802,775 B2 10/2004 Baerlocher et al.
6,805,349 B2 10/2004 Baerlocher et al.
6,835,132 B2 12/2004 Bennett
6,852,030 B2 2/2005 Baerlocher et al.
6,855,053 B2 2/2005 Baerlocher
6,855,054 B2 2/2005 White et al.
6,866,583 B2 3/2005 Glavich et al.
6,878,061 B2 4/2005 Baerlocher et al.
6,905,406 B2 6/2005 Kaminkow et al.
6,910,962 B2 6/2005 Marks et al.
6,913,532 B2 7/2005 Baerlocher et al.
6,921,335 B2 7/2005 Rodgers et al.
6,929,952 B2 8/2005 Baerlocher
6,935,955 B1 8/2005 Kaminkow et al.
6,939,224 B2 9/2005 Palmer et al.
6,939,226 B1 9/2005 Joshi
6,958,013 B2 10/2005 Miereau et al.
6,960,133 B1 11/2005 Marks et al.
6,960,134 B2 11/2005 Hartl et al.
6,986,710 B2 1/2006 Baerlocher et al.
6,997,802 B2 2/2006 Gauselmann
6,997,804 B2 2/2006 Berman
6,997,808 B2 2/2006 Rodgers et al.
7,001,274 B2 2/2006 Baerlocher et al.
7,014,560 B2 3/2006 Glavich et al.
7,040,983 B2 5/2006 Dolloff et al.
7,040,985 B2 5/2006 Vancura
7,040,987 B2 5/2006 Walker et al.
7,052,395 B2 5/2006 Glavich et al.
7,056,209 B2 6/2006 Baerlocher et al.
7,056,213 B2 6/2006 Ching et al.
7,059,967 B2 6/2006 Baerlocher
7,070,502 B1 7/2006 Bussick et al.
7,074,127 B2 7/2006 Cuddy et al.
7,090,579 B2 8/2006 Tarantino
7,090,580 B2 8/2006 Rodgers et al.
7,104,886 B2 9/2006 Baerlocher et al.
7,121,942 B2 10/2006 Baerlocher
7,153,205 B2 12/2006 Baerlocher
7,252,590 B2 8/2007 Palmer et al.
7,316,613 B2 1/2008 Luccesi et al.
7,371,169 B2 5/2008 Baerlocher
7,371,170 B2 5/2008 Cregan et al.
7,381,134 B2 6/2008 Cuddy et al.
7,384,334 B2 6/2008 Glavich et al.
7,387,570 B2 6/2008 Randall
7,399,228 B2 7/2008 Baerlocher
7,402,103 B2 7/2008 Baerlocher
7,833,101 B2 11/2010 Lutnick et al.
8,235,780 B2 8/2012 Nicely
2002/0077165 A1 6/2002 Bansemer et al.
2003/0027619 A1 2/2003 Nicastro
2003/0064771 A1 4/2003 Morrow et al.
2003/0064807 A1 4/2003 Walker et al.
2003/0157981 A1 8/2003 Marks et al.
2003/0203753 A1 10/2003 Muir et al.
2003/0224850 A1 12/2003 Anderson et al.
2004/0023714 A1 2/2004 Van Asdale
2004/0033829 A1 2/2004 Pacey et al.
2004/0048646 A1 3/2004 Visocnik
2004/0048657 A1 3/2004 Gauselmann
2004/0053661 A1 3/2004 Jones et al.
2004/0053669 A1 3/2004 Gerrard et al.
2004/0053670 A1 3/2004 Rothkranz et al.
2004/0053676 A1 3/2004 Rodgers
2004/0053677 A1 3/2004 Hughs-Baird
2004/0053695 A1 3/2004 Mattice et al.
2004/0063489 A1 4/2004 Crumby
2004/0067790 A1 4/2004 Peterson et al.
2004/0077396 A1 4/2004 Poole et al.
2004/0082373 A1 4/2004 Cole et al.
2004/0097282 A1 5/2004 Baerlocher et al.
2004/0116175 A1 6/2004 Aida
2004/0142739 A1 7/2004 Loose et al.
2004/0198489 A1 10/2004 Kaminkow et al.
2004/0209685 A1 10/2004 Lucchesi et al.
2004/0219969 A1 11/2004 Casey et al.
2004/0259325 A1 12/2004 Randall et al.
2004/0266520 A1 12/2004 Aida
2005/0020344 A1 1/2005 Kaminkow
2005/0049035 A1 3/2005 Baerlocher et al.
2005/0049036 A1 3/2005 Mead
2005/0054415 A1 3/2005 Kaminkow et al.
2005/0054421 A1 3/2005 Hughs-Baird et al.
2005/0054434 A1 3/2005 Baerlocher et al.
2005/0064924 A1 3/2005 Glavich et al.
2005/0064926 A1 3/2005 Walker et al.
2005/0064935 A1 3/2005 Blanco
2005/0070354 A1 3/2005 Baerlocher et al.
2005/0075159 A1* 4/2005 Kaminkow ..... G07F 17/32 463/16
2005/0101380 A1 5/2005 Glavich et al.
2005/0107154 A1 5/2005 Pacey
2005/0130729 A1 6/2005 Baerlocher et al.
2005/0130731 A1 6/2005 Englman et al.
2005/0130737 A1 6/2005 Englman et al.
2005/0143165 A1 6/2005 Berman et al.
2005/0148381 A1 7/2005 Marks et al.
2005/0148384 A1 7/2005 Marks et al.
2005/0176494 A1 8/2005 Thomas
2005/0215311 A1 9/2005 Hornik et al.
2005/0227754 A1 10/2005 Kaminkow et al.
2005/0282615 A1 12/2005 Englman et al.
2005/0282620 A1 12/2005 Marks et al.
2005/0288094 A1 12/2005 Marks et al.
2006/0009277 A1 1/2006 Hartl et al.
2006/0030392 A1 2/2006 Rodgers et al.
2006/0030396 A1 2/2006 Marks et al.
2006/0030401 A1 2/2006 Mead et al.
2006/0063584 A1 3/2006 Brill et al.
2006/0068875 A1 3/2006 Cregan et al.
2006/0068882 A1 3/2006 Baerlocher et al.
2006/0068883 A1 3/2006 Randall et al.
2006/0073876 A1 4/2006 Cuddy
2006/0084493 A1 4/2006 Pederson et al.
2006/0084494 A1 4/2006 Belger et al.
2006/0084496 A1 4/2006 Jaffe et al.
2006/0089191 A1 4/2006 Singer et al.
2006/0111174 A1 5/2006 Baerlocher et al.
2006/0116195 A1 6/2006 Baerlocher et al.
2006/0135247 A1 6/2006 Baerlocher et al.

(56) References Cited

U.S. PATENT DOCUMENTS

| | | | | |
|---|---|---|---|---|
| 2006/0142077 | A1 | 6/2006 | Miles et al. | |
| 2006/0199636 | A1 | 9/2006 | Ching et al. | |
| 2006/0199637 | A1 | 9/2006 | Ching et al. | |
| 2006/0252492 | A1 | 11/2006 | Anderson et al. | |
| 2007/0060252 | A1 | 3/2007 | Taylor | |
| 2007/0060294 | A1 | 3/2007 | Cuddy et al. | |
| 2007/0060300 | A1 | 3/2007 | Baerlocher | |
| 2007/0087809 | A1 | 4/2007 | Baerlocher | |
| 2007/0270204 | A1 | 11/2007 | Palmer et al. | |
| 2008/0064481 | A1 | 3/2008 | Jackson et al. | |
| 2008/0113735 | A1* | 5/2008 | Maya | G07F 17/32 463/20 |
| 2008/0139296 | A1 | 6/2008 | Baerlocher et al. | |
| 2008/0153564 | A1 | 6/2008 | Baerlocher et al. | |
| 2008/0182650 | A1 | 7/2008 | Randall et al. | |
| 2008/0200237 | A1 | 8/2008 | Cuddy et al. | |
| 2009/0117979 | A1 | 5/2009 | Decasa, Jr. et al. | |
| 2016/0180641 | A1* | 6/2016 | Hughes | G07F 17/3265 463/20 |

FOREIGN PATENT DOCUMENTS

| | | |
|---|---|---|
| EP | 1 079 345 | 2/2001 |
| GB | 1 242 298 | 8/1971 |
| GB | 2 062 923 | 5/1981 |
| GB | 2 066 991 | 7/1981 |
| GB | 2 072 395 | 9/1981 |
| GB | 2 096 376 | 10/1982 |
| GB | 2 137 392 | 10/1984 |
| GB | 2 253 299 | 9/1992 |
| GB | 2 372 617 | 8/2002 |
| WO | WO 1997/32285 | 9/1997 |
| WO | WO 2000/12186 | 3/2000 |
| WO | WO 2002/18025 | 3/2002 |
| WO | WO 2004/026417 | 4/2004 |
| WO | WO 2005/058444 | 6/2005 |
| WO | WO 2005/079936 | 9/2005 |

OTHER PUBLICATIONS

18-Reeler, Article, written by Global Gaming Business, published on Jun. 15, 2003.
Andy Capp, Article, written by Strictly Slots, published in Feb. 2002.
Andy Capp Game Description, written by Bally Gaming Systems, published in 2001.
"Monopoly Movers & Shakers Williams/WMS Gaming," Article, published by Strictly Slots in Jul. 2000.
Bally Live! Special Global Gaming Expo 2002 Issue, written by Bally Gaming Systems, published in Fall, 2002.
Break the Spell, Brochure, written by Atronic, published in 1999.
Crazy Fruits, Advertisement, written by Atronic, published in 2000.
Crazy Fruits, Article, written by Strictly Slots, pulished in 2001.
Enchanted Unicorn—Unicorn Bonus Advertisements, written by IGT, published in 2001.
Jackpot Party, Brochures and Articles, published by WMS Gaming, Inc. in 1998.
Jazzy Jackpots, Advertisements, written by Atronic, published in 2000.
Jazzy Jackpots, Article, written by Strictly Slots, published in Mar. 2001.
Pink Panther, Advertisement and Article, written by IGT, published in 2000.
Screen Shots of "Race Car Bonus Feature," written by IGT, available in Dec. 1998.
Slot Machines, written by Marshall fey, p. 126, 150 published in Reno, NV 1983, 2nd 1989, 3rd 1991.
Slots 2003, written by Melissa Raimondi, published in Jan. 2003.
Yahtzee Instructions written by Milton Bradley Company, pp. 1-8.
Yahtzee Video Game, Brochure, published by Mikohn in 1999.

* cited by examiner

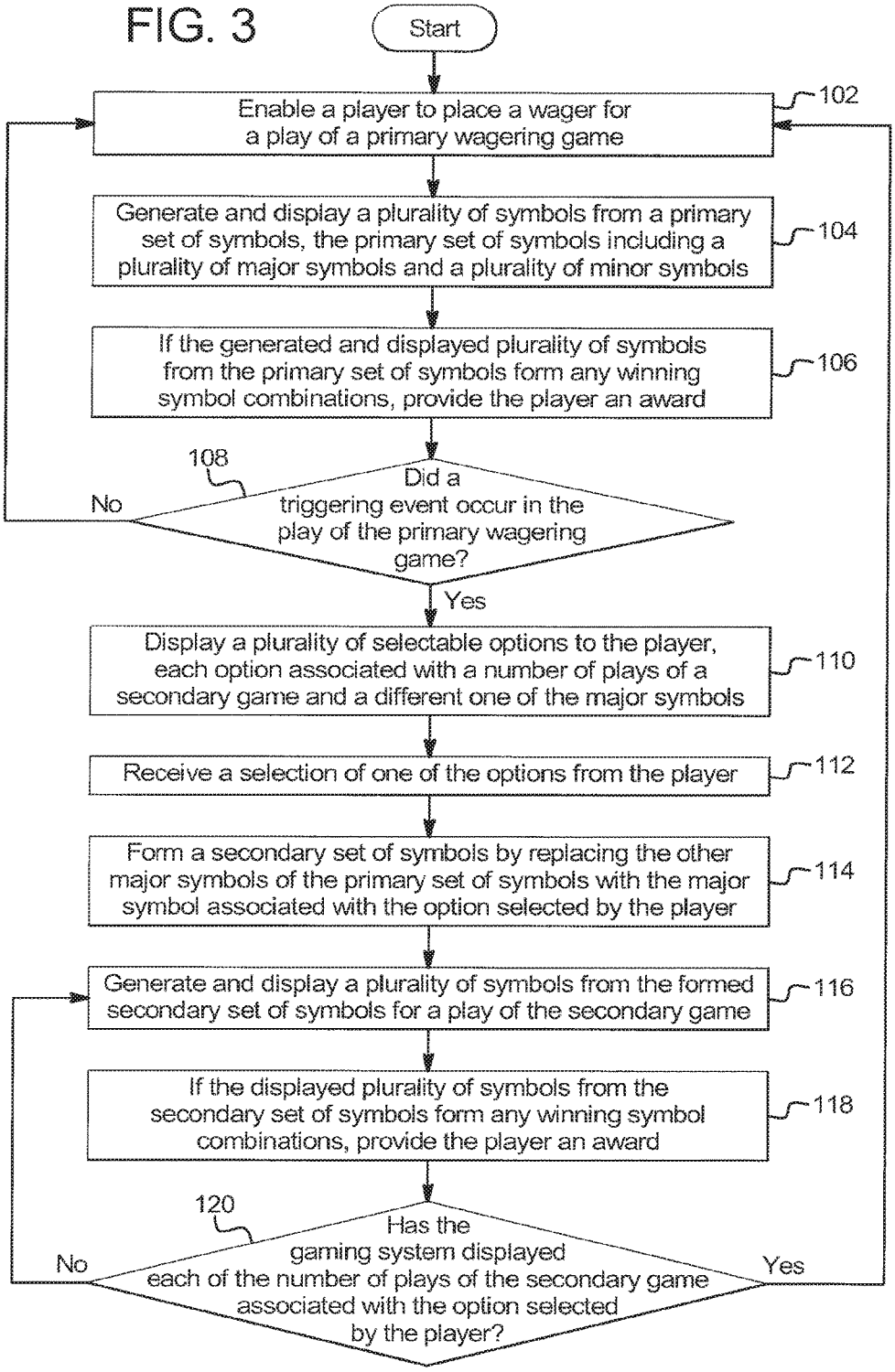
FIG. 3
Start
Enable a player to place a wager for a play of a primary wagering game
102
Generate and display a plurality of symbols from a primary set of symbols, the primary set of symbols including a plurality of major symbols and a plurality of minor symbols
104
If the generated and displayed plurality of symbols from the primary set of symbols form any winning symbol combinations, provide the player an award
106
108
Did a triggering event occur in the play of the primary wagering game?
No
Yes
Display a plurality of selectable options to the player, each option associated with a number of plays of a secondary game and a different one of the major symbols
110
Receive a selection of one of the options from the player
112
Form a secondary set of symbols by replacing the other major symbols of the primary set of symbols with the major symbol associated with the option selected by the player
114
Generate and display a plurality of symbols from the formed secondary set of symbols for a play of the secondary game
116
If the displayed plurality of symbols from the secondary set of symbols form any winning symbol combinations, provide the player an award
118
120
Has the gaming system displayed each of the number of plays of the secondary game associated with the option selected by the player?
No
Yes

FIG. 9

| Free Spin | Free Spin Award Amount |
|---|---|
| 1 | 200 |
| 2 | 0 |
| 3 | 0 |
| 4 | 100 |
| 5 | 400 |

Total Award: 700

FIG. 17

| Free Spin | Free Spin Award Amount |
|---|---|
| 1 | 100 |
| 2 | 20 |
| 3 | 0 |
| 4 | 50 |
| 5 | 0 |
| 6 | 0 |
| 7 | 30 |
| 8 | 50 |
| 9 | 0 |
| 10 | 100 |

Total Award: 350

GAMING SYSTEM, GAMING DEVICE, AND METHOD FOR ENABLING A PLAYER TO SELECT VOLATILITY USING GAME SYMBOLS

PRIORITY CLAIM

This patent application is a continuation of, and claims priority to and the benefit of, U.S. patent application Ser. No. 14/515,212, which was filed on Oct. 15, 2014, which is a continuation of, and claims priority to and the benefit of, U.S. patent application Ser. No. 13/954,515, which was filed on Jul. 30, 2013 and issued as U.S. Pat. No. 8,876,590 on Nov. 4, 2014, which is a continuation of, and claims priority to and the benefit of, U.S. patent application Ser. No. 12/271,278, which was filed on Nov. 14, 2008 and issued as U.S. Pat. No. 8,506,380 on Aug. 13, 2013, the entire contents of each of which are incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming devices provide enjoyment and excitement to players, in part, because they may ultimately lead to monetary awards for the players. Gaming devices also provide enjoyment and excitement to players because they are fun to play. Bonus features or secondary games, in particular, provide gaming device manufacturers with the opportunity to add enjoyment and excitement to that which is already expected from a base or primary game of the gaming device. Bonus features provide additional gaming experiences to the player and generally provide a greater expectation of winning than the primary game alone. While the outcomes of wagering games are determined at least in part by luck, the ability of the player to vary certain aspects of the game provides the player with a sense of control and enhances the player's gaming experience.

One known type of gaming device enables the player to potentially affect his or her volatility, and in particular, the gaming device prompts the player to select from a plurality of different choices for use in a number of free plays of a game provided to the player. For example, the gaming device enables the player to select one of: (a) five free plays of the game at a 20× multiplier, and (b) ten free plays of the game at a 10× multiplier. If the player chooses five free plays of the game at the 20× multiplier, the player chooses the higher volatility. That is, the player chooses to play the game fewer times (resulting in a lower probability of winning awards), however, the average magnitude of awards won is relatively large. If the player chooses ten free plays of the game at the 10× multiplier, the player chooses the lower volatility. That is, the player chooses to play the game more times (resulting in a higher probability of winning awards), however, the average magnitude of awards won is relatively smaller. While this sense of control may enhance the player's gaming experience, the player can easily determine that the different options provide the same average expected payout.

There is a continuing need for new and different games and gaming machines.

SUMMARY

Various embodiments of the gaming system, gaming device, and gaming method disclosed herein provide a primary game and a free activation bonus sequence, wherein the gaming system enables the player to select one or more of a plurality of different volatility choices or options for use in the free activation bonus sequence. Each option is associated with a different number of free activations and a different pool of symbols or different symbol functionality. The gaming system provides this variation in the pool of symbols or symbol functionality in various embodiments by enabling the player to replace one or more symbols of a pool or set of symbols of the primary game (i.e., the primary set of symbols) with the symbol associated with a player selected option. The symbols of this modified set of symbols (i.e., the secondary set of symbols) are used in the free activation bonus sequence.

More specifically, in one embodiment, for a play of the primary wagering game, the gaming system randomly generates and displays a plurality of symbols from a primary set of symbols. The gaming system determines if any winning symbol combinations are generated and displayed, and provides the player with any awards associated with the generated and displayed winning symbol combinations. The primary set of symbols includes a plurality of major symbols and a plurality of minor symbols. The major symbols generally have larger awards associated with winning symbol combinations which include the major symbols, and the minor symbols generally have smaller awards associated with winning symbol combinations which include the minor symbols. Generally, one or more characteristics distinguish the major symbols from the minor symbols. For example, displayed major symbols may be larger than the minor symbols, or the major symbols may be associated with a particular theme, whereas the minor symbols are generally more common symbols such as numbers, card symbols, and/or traditional slot machine symbols (i.e., fruits, bells, coins, etc.). Upon a triggering event in or associated with the primary game, the gaming system enables the player to select from a plurality of different options. Each option is associated with a different number of plays of a secondary game and a different one of the major symbols. After the player selects one of the options, the gaming system modifies the primary set of symbols by replacing each of the other major symbols of the primary set of symbols with the major symbol associated with the player selected option. For each of the number of plays of the secondary game associated with the player selected option, the gaming system randomly generates and displays a plurality of symbols from this modified set of symbols (i.e., the secondary set of symbols) and provides any awards associated with any winning symbol combinations generated and displayed for the play of the secondary game.

It should be appreciated that instead of modifying the primary set of symbols by replacing each designated symbol in the primary set with a different symbol for the number of plays of the secondary game, the gaming system may, for each of the plays of the secondary game, randomly generate a plurality of the symbols from the primary set of symbols (without modifying the primary set of symbols) and there-after replace the designated symbols of the generated plurality of symbols with one or more different symbols.

Additional features and advantages are described in, and will be apparent from, the following Detailed Description and the figures.

BRIEF DESCRIPTION OF THE FIGURES

FIG. 3 is a flow chart illustrating operation of one embodiment of the gaming system disclosed herein.

FIG. 9 is a table illustrating an example of the awards provided to the player for each of a number of plays of a secondary game associated with a player selected option.

FIG. 17 is a table illustrating an example of the awards provided to the player for each of a number of plays of a secondary game associated with a player selected option.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
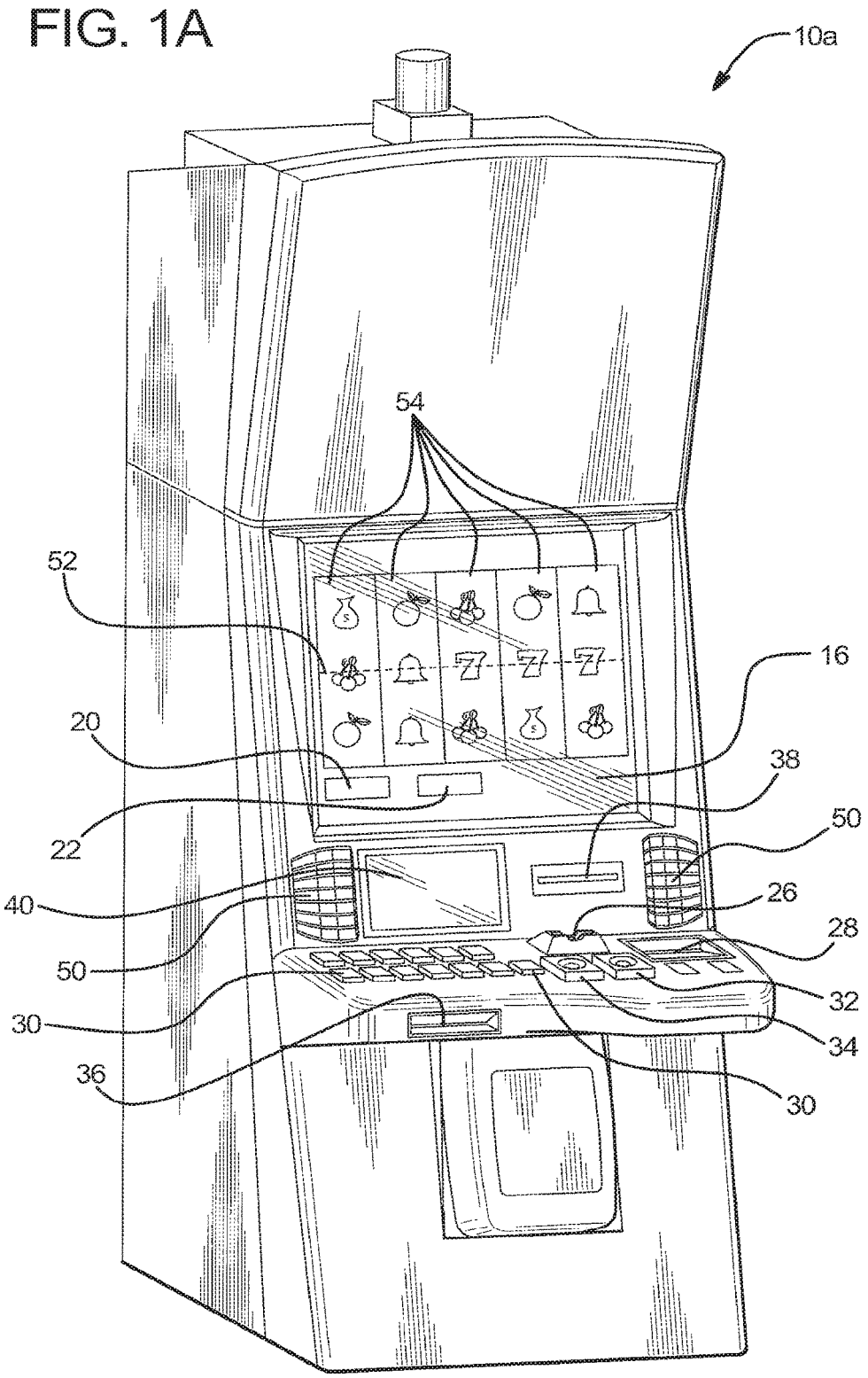
FIGS. 1A and 1B are front perspective views of alternative embodiments of gaming devices disclosed herein.
Figure 1B:
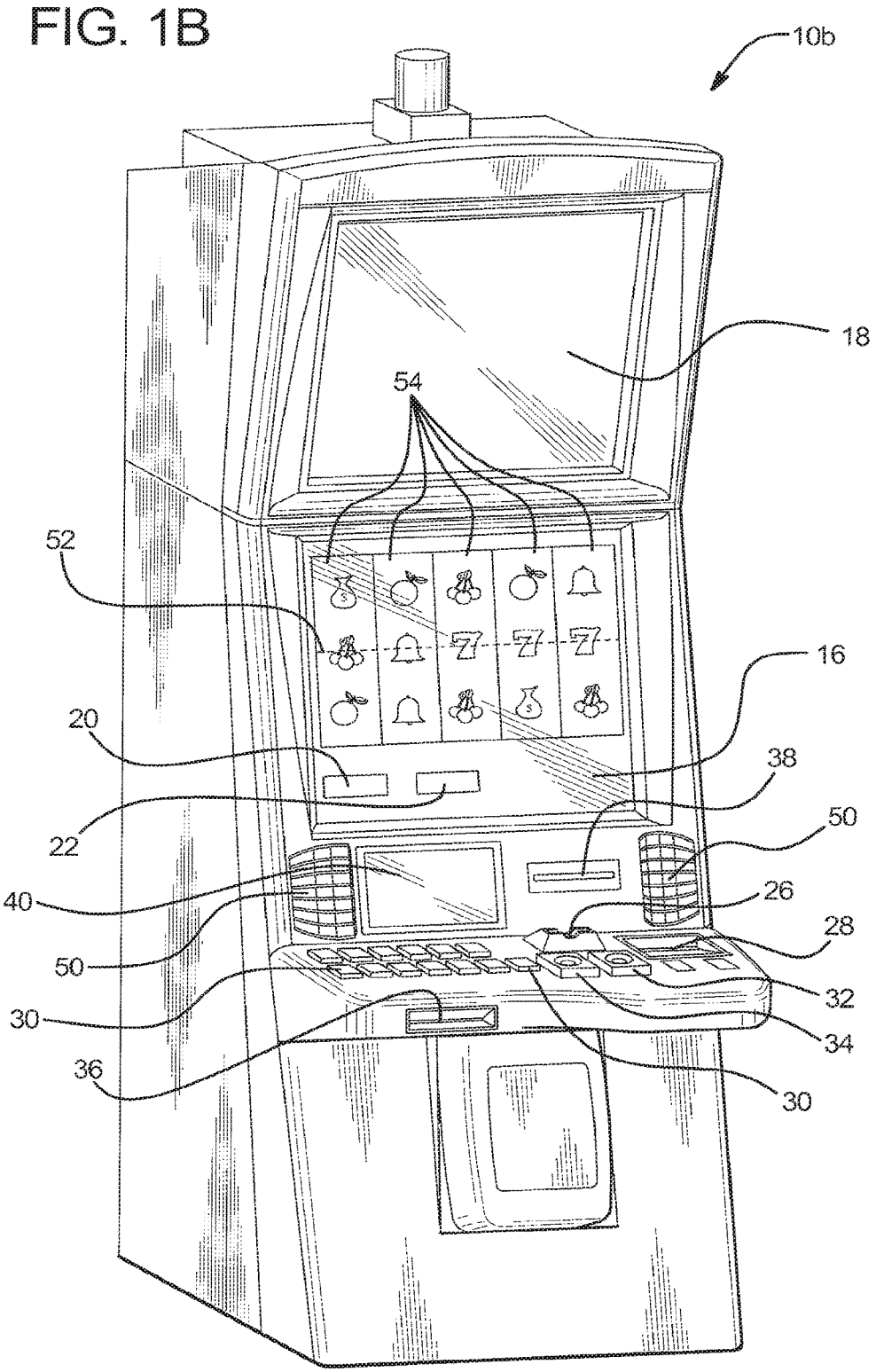

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
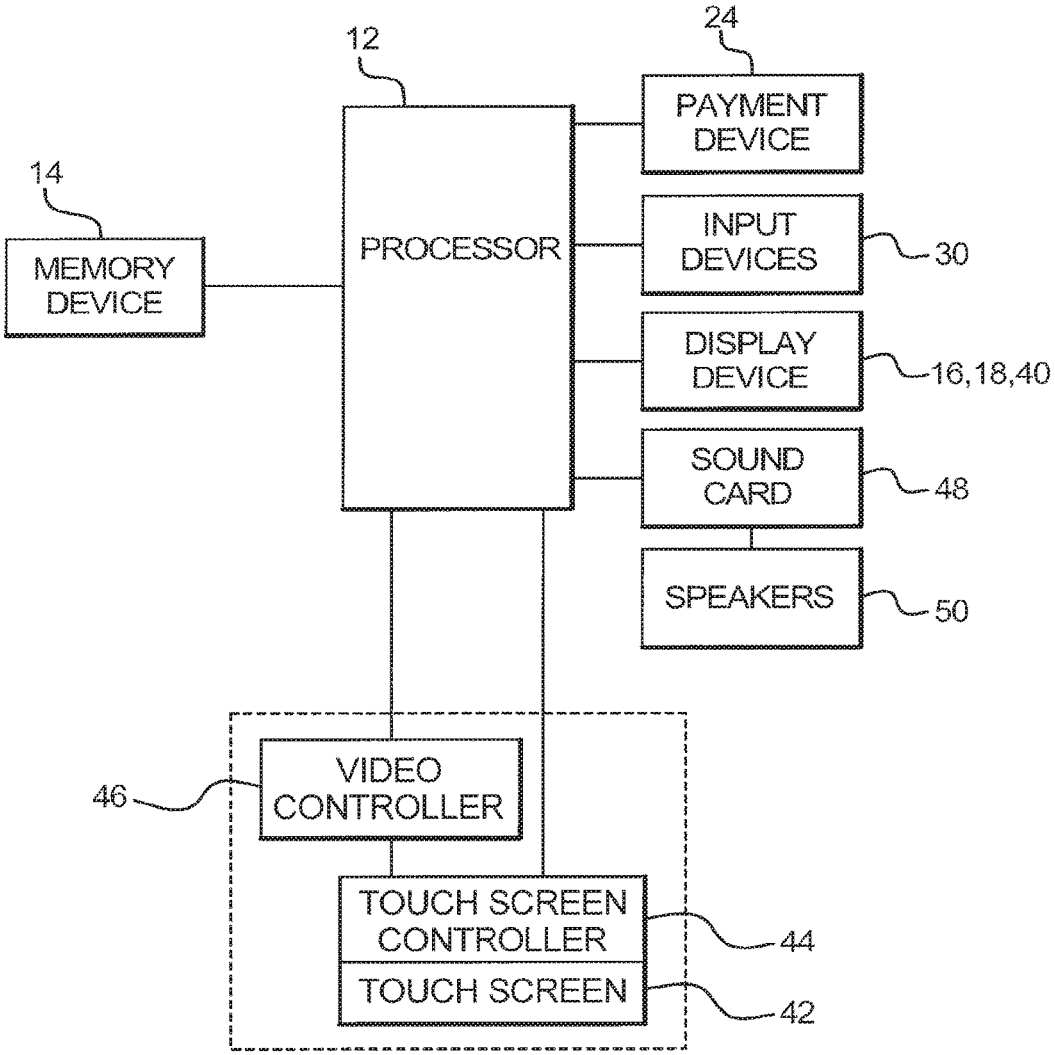
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, a repeat the bet button, an enter button, or a spin button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded.

In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
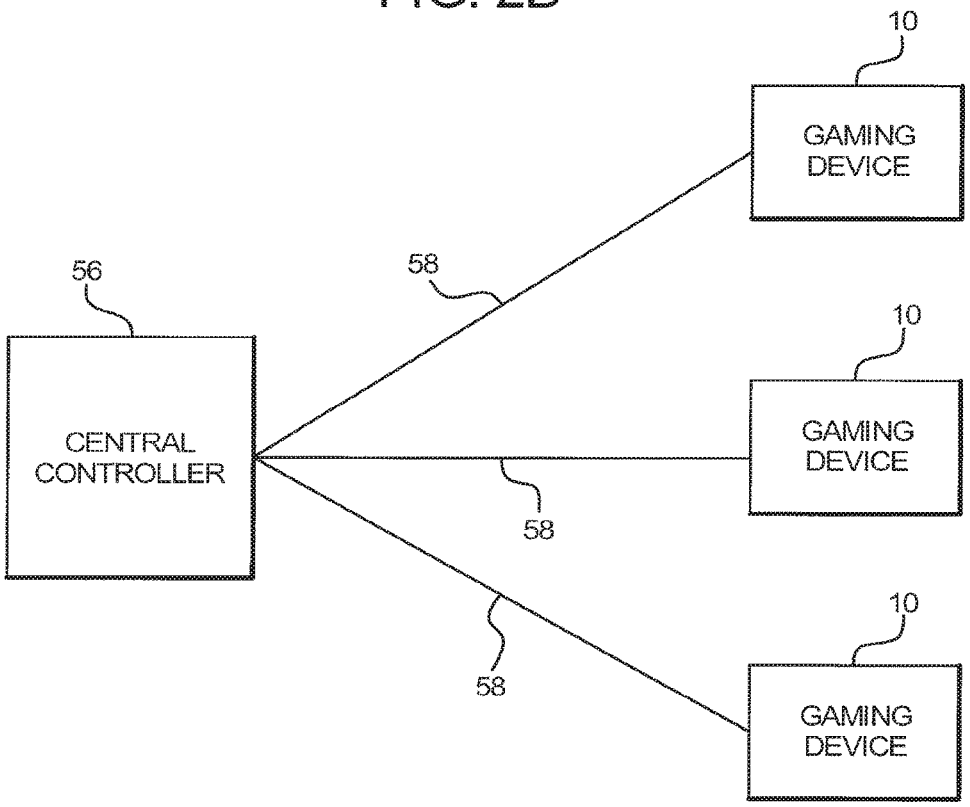
FIG. 2B is a schematic diagram of the central server in communication with a plurality of gaming machines in accordance with one embodiment of the gaming system disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device (s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Player Selection of Volatility Embodiments

In one embodiment, the present disclosure is implemented with slot machines or Internet slot play. As seen in FIGS. 1A and 1B, each slot machine (and the Internet version of slot) includes one or more paylines 52. Paylines 52 may be horizontal, vertical, circular, diagonal, angled or any combination thereof. Slot machine gaming system 10 displays a plurality of reels 54, such as 3 to 5 reels in either electromechanical form with mechanical rotating reels or in video form with simulated reels and movement. It should be appreciated that any suitable number of reels may be employed in the wagering game.

Referring now to FIG. 3, in one embodiment, the gaming system enables a player to place a wager for a play of a primary wagering game as indicated by block 102. After the player places the wager for the play of the primary wagering game, the gaming system generates and displays a plurality of symbols from a primary set of symbols as indicated by block 104. In this embodiment, the primary set of symbols includes a plurality of major symbols and a plurality of minor symbols. As indicated by block 106, if the generated and displayed symbols form any winning symbol combinations, the gaming system provides the player with an award associated with the generated and displayed winning symbol combinations.

After the gaming system provides the player with any awards for the play of the primary wagering game, the gaming system determines if a triggering event occurred in or associated with the play of the primary wagering game as indicated by block 108. If a triggering event did not occur in or associated with the play of the primary wagering game, the gaming system enables the player to place a wager for another play of the primary wagering game, and repeats the steps illustrated by blocks 102 through 108. If the triggering event did occur in or associated with the play of the primary game, the gaming system displays a plurality of selectable options to the player as indicated by block 110. Each of the selectable options is associated with a different number of plays of a secondary game and a different one of the major symbols (i.e., a different set of symbols). It should be appreciated that a plurality or all of the selectable options may be associated with the same number of plays of the secondary game and/or a plurality or all of the options may be associated with the same set of symbols.

Upon receiving the player's selection of one of the options as indicated by block 112, the gaming system forms a secondary set of symbols by replacing the other major symbols of the primary set of symbols with the major symbol associated with the option selected by the player as indicated by block 114. It should be appreciated that if the player selects the first option, the formed secondary set of symbols is a first sub-set of the symbols of the primary set of symbols. Likewise, if the player selects the second option, the formed secondary set of symbols is a second sub-set of the symbols of the primary set of symbols. The gaming system then generates and displays a plurality of symbols from the formed secondary set of symbols for a play of a secondary game as indicated by block 116. As indicated by block 118, if the generated and displayed symbols form any winning symbol combinations, the gaming system provides the player with an award associated with the generated and displayed winning symbol combinations. As indicated by block 120, the gaming system determines if each of the number of plays of the secondary game associated with the option selected by the player has been displayed. If not, the gaming system repeats the steps illustrated by blocks 116 through 120 until each of the number of plays of the secondary game associated with the option selected by the player has been played. If each of the number of plays of the secondary game associated with the option selected by the player has been played, the gaming system enables the player to place a wager for another play of the primary wagering game as indicated by block 102.

Figure 4:
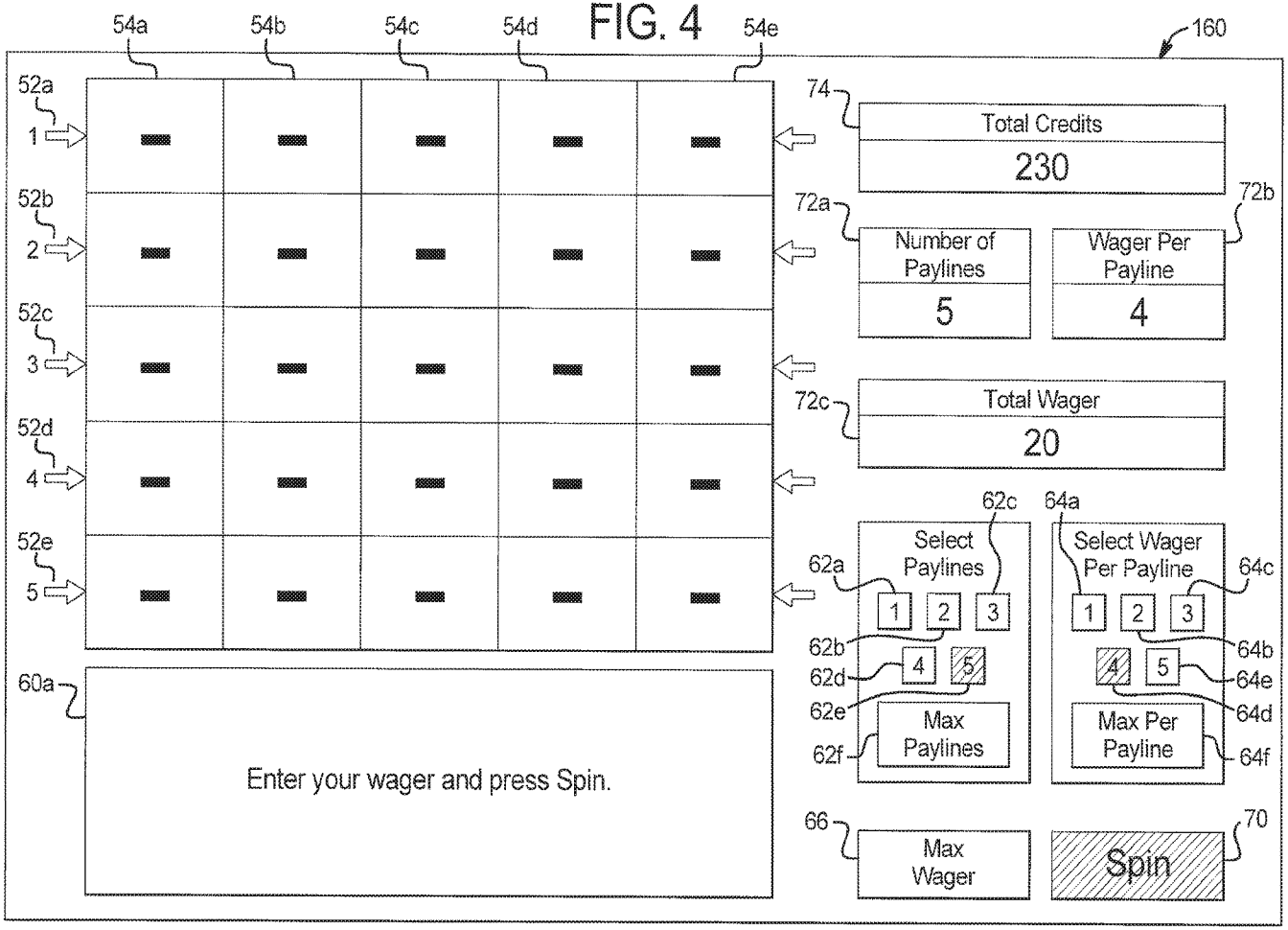
FIGS. 4, 5, 6, 7, and 8 are enlarged views of one of the displays of an example of the embodiment of FIG. 3, and illustrate an example of the operation of the embodiment of FIG. 3.

An example of the operation of the embodiment of FIG. 3 is illustrated in FIG. 4 through FIG. 9. Referring now to FIG. 4, the gaming system enables the player to place a wager for a play of the primary wagering game. An audio, visual, or audiovisual message 60*a* prompts the player to enter the wager. Wager inputs 62, 64, and 66 include select paylines inputs 62*a* to 62*f*, which enable the player to change the paylines wagered, and select wager per payline inputs 64*a* to 64*f*, which enable the player to input the wager amount for the paylines wagered. In this illustrated example, the player initially has 250 credits. The player uses select paylines button 62*e* to select five paylines, and the player wagers four credits per payline by using select wager per payline button 64*d*. Wager displays 72*a*, 72*b*, and 72*c* indicate the number of paylines wagered (e.g., five paylines), the wager per payline (e.g., four credits), and the total wager (e.g., twenty credits) for the play of the primary wagering game, respectively. After selecting the number of paylines wagered and the wager per payline, the player uses spin input 70 to set the wager and start the play of the primary wagering game. The gaming system debits 20 credits from the player's total credits and total credit meter 74 indicates that the player has 230 total credits remaining.

Figure 5:
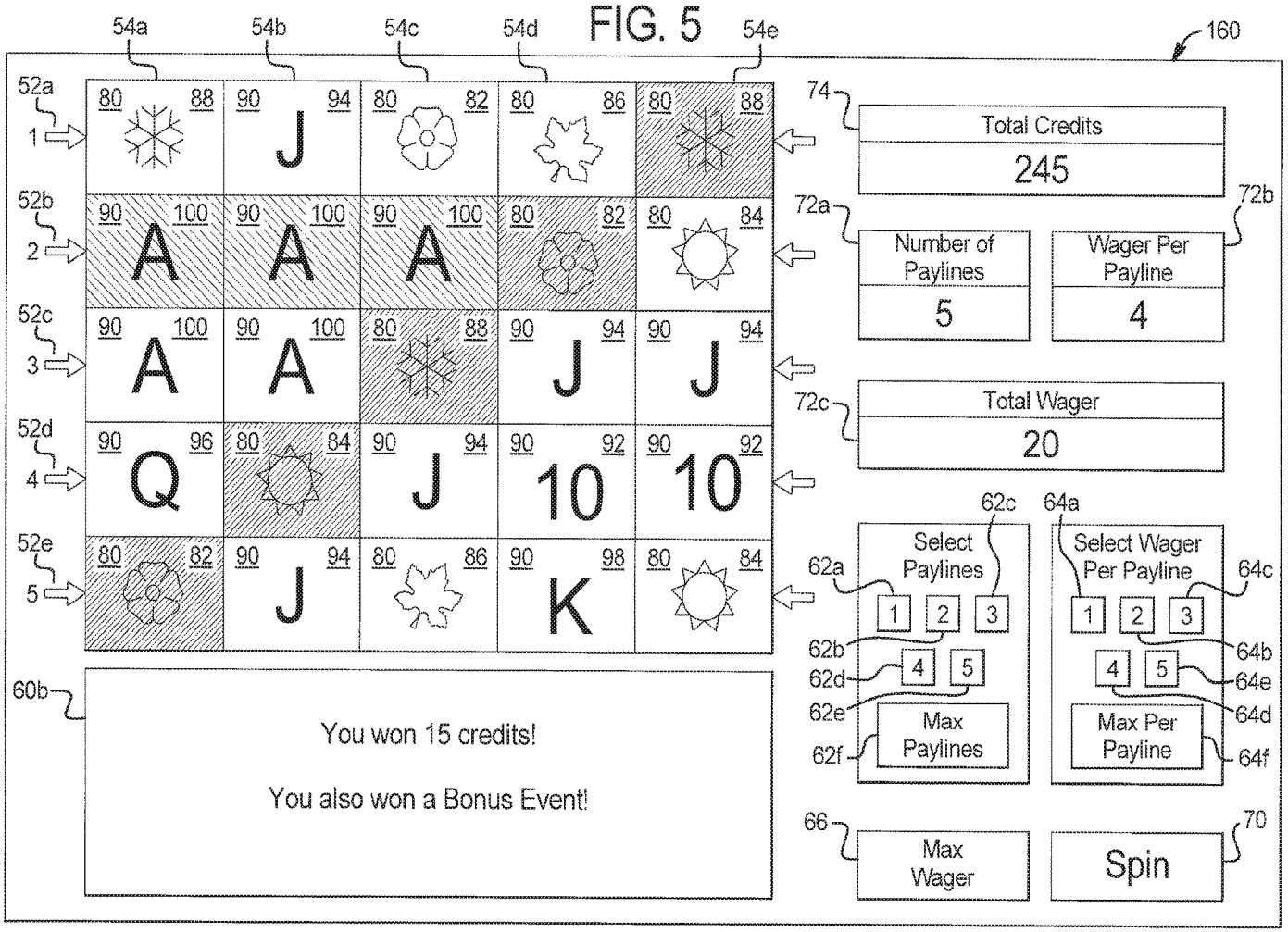

As illustrated in FIG. 5, the gaming system randomly generates and displays an outcome of the play of the primary wagering game. Specifically, in electromechanical form, stepper motors in an embodiment rotate and stop the reels at the randomly determined positions. In video form, reels 54 are simulated to spin and stop through a video and/or animation display on display devices 16 and/or 18. Reels 54 include the symbols of the primary set of symbols. The primary set of symbols includes a plurality of major symbols 80, and a plurality of minor symbols 90. Major symbols 80 include four different types of symbols. Specifically, major symbols 80 include a plurality of spring symbols 82, a plurality of summer symbols 84, a plurality of autumn symbols 86, and a plurality of winter symbols 88. Similarly, minor symbols 90 include a plurality of "10" symbols 92, a plurality of "J" symbols 94, plurality of "Q" symbols 96, a plurality of "K" symbols 98, and a plurality of "A" symbols 100.

After the gaming system generates and displays a plurality of the symbols of reels 54 (i.e., a plurality of symbols of the first set of symbols), the gaming system determines that the combination of three "A" symbols 100 on payline two 52*b* is a winning symbol combination as illustrated by FIG. 5. The gaming system provides the player an award of 15 credits for the winning symbol combination. Message 60*b* indicates the award to the player, and the number of credits displayed by total credit meter 74 increases by 15 credits to 245 credits. Additionally, the combination of five major symbols 90 displayed on diagonally is a triggering event which causes the gaming system to initiate a free activation bonus sequence.

Figure 6:
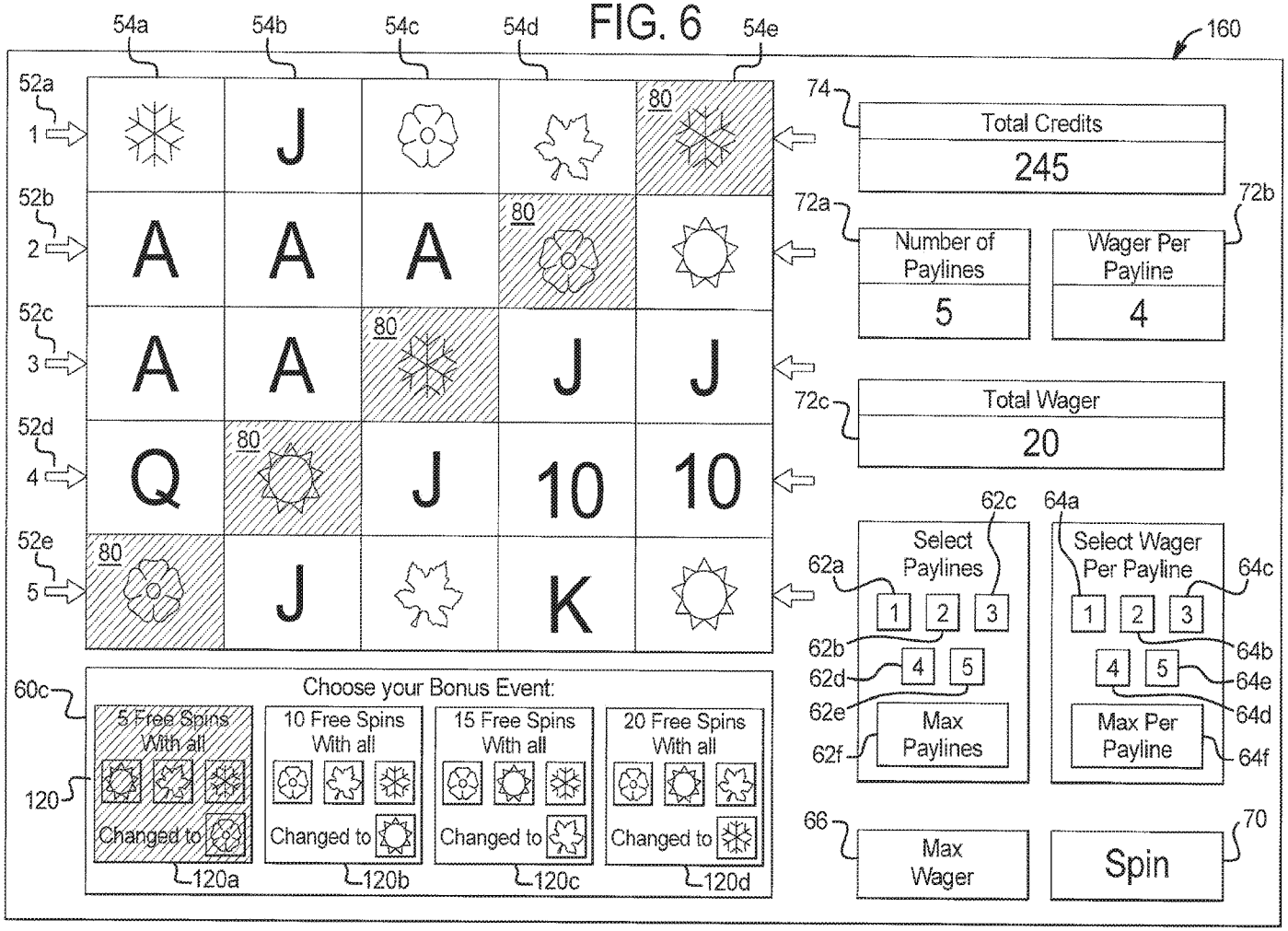

Referring now to FIG. 6, as a result of the triggering event, the gaming system enables the player to select one of a plurality of displayed options 120. Each displayed option 120 indicates that the player's selection of the option causes the gaming system to provide the player with a different number of free spins of reels played with three of the four types of major symbols 80 of reels replaced with the remaining fourth major symbol. For example, as illustrated in FIG. 6, if the player selects option 120*a*, the gaming system modifies the symbols of reels 54 (i.e., the primary set of symbols) by replacing each of the summer symbols 84, autumn symbols 86, and winter symbols 88 of the reels with spring symbols 82. The symbols of the modified reels form a secondary set of symbols, which includes only minor symbols 90 and spring symbols 82. As a result of the player selecting option 120*a*, the gaming system provides the player with five free spins of the modified reels. For each free spin, the gaming system randomly generates and displays a plurality of the symbols of modified reels 54 (i.e., the secondary set of symbols), and provides the player with any awards associated with the generated and displayed symbols. By enabling the player to choose from a plurality of volatility options having varied pools of symbols or symbol functionality for the free activation bonus sequence, the volatility and average expected payout per activation associated with each option are not as transparent to the player. Thus, the gaming system may provide the player with a perception of more control over the play of the game, and therefore provide more excitement and intrigue to the player.

Figure 7:
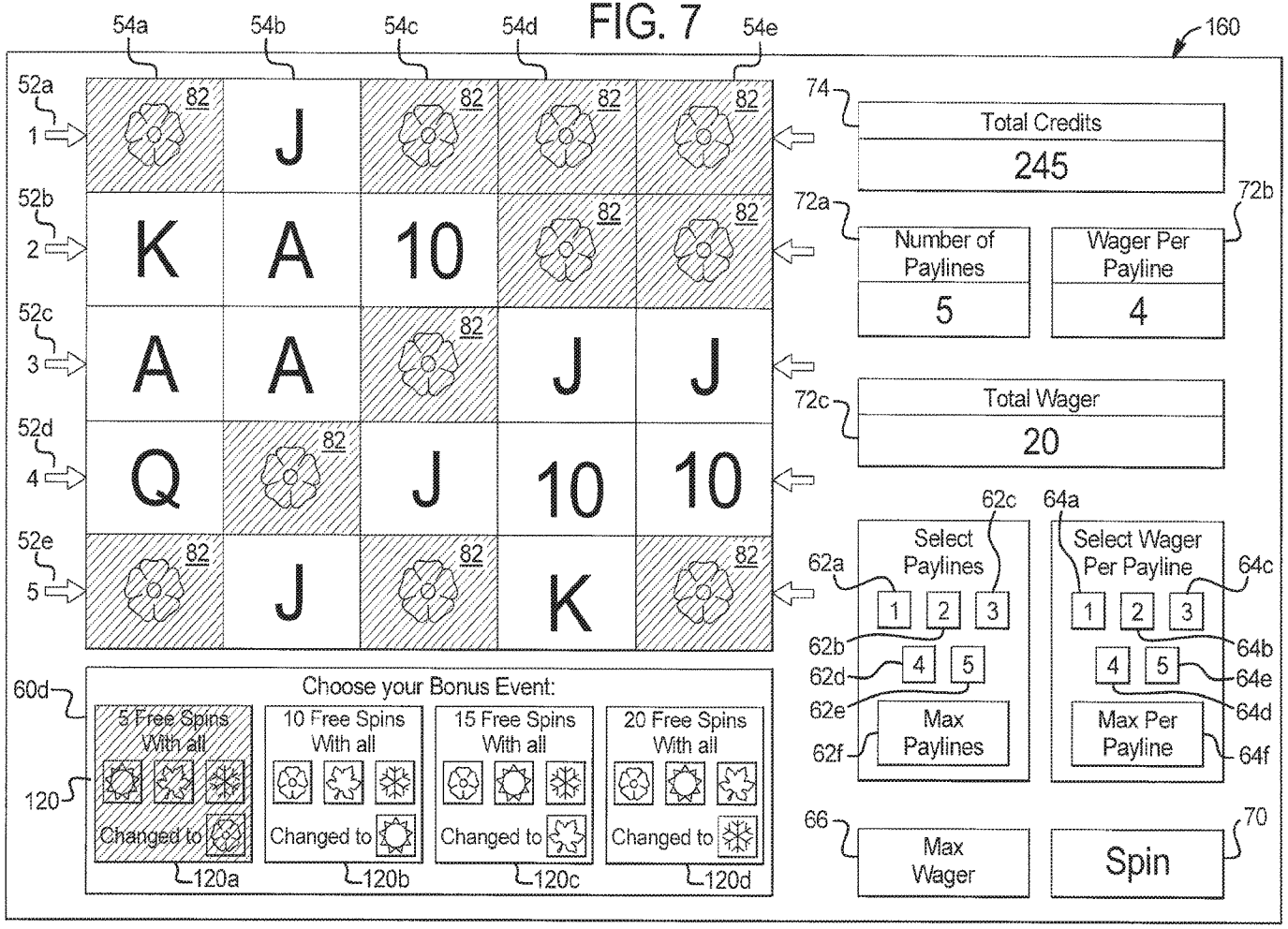

Referring now to FIG. 7, in this embodiment, the player selects option 120*a*. After the player selects option 120*a*, the gaming system modifies the symbols of the reels by replacing each of the summer symbols 84, autumn symbols 86, and winter symbols 88 of reels 54 with spring symbols 82. Message 60*d* informs the player that the summer symbols 84, autumn symbols 86, and winter symbols 88 have been changed to spring symbols 82, and prompts the player press spin button 70 to play the first free spin (i.e., the first free play of the secondary game).

Figure 8:
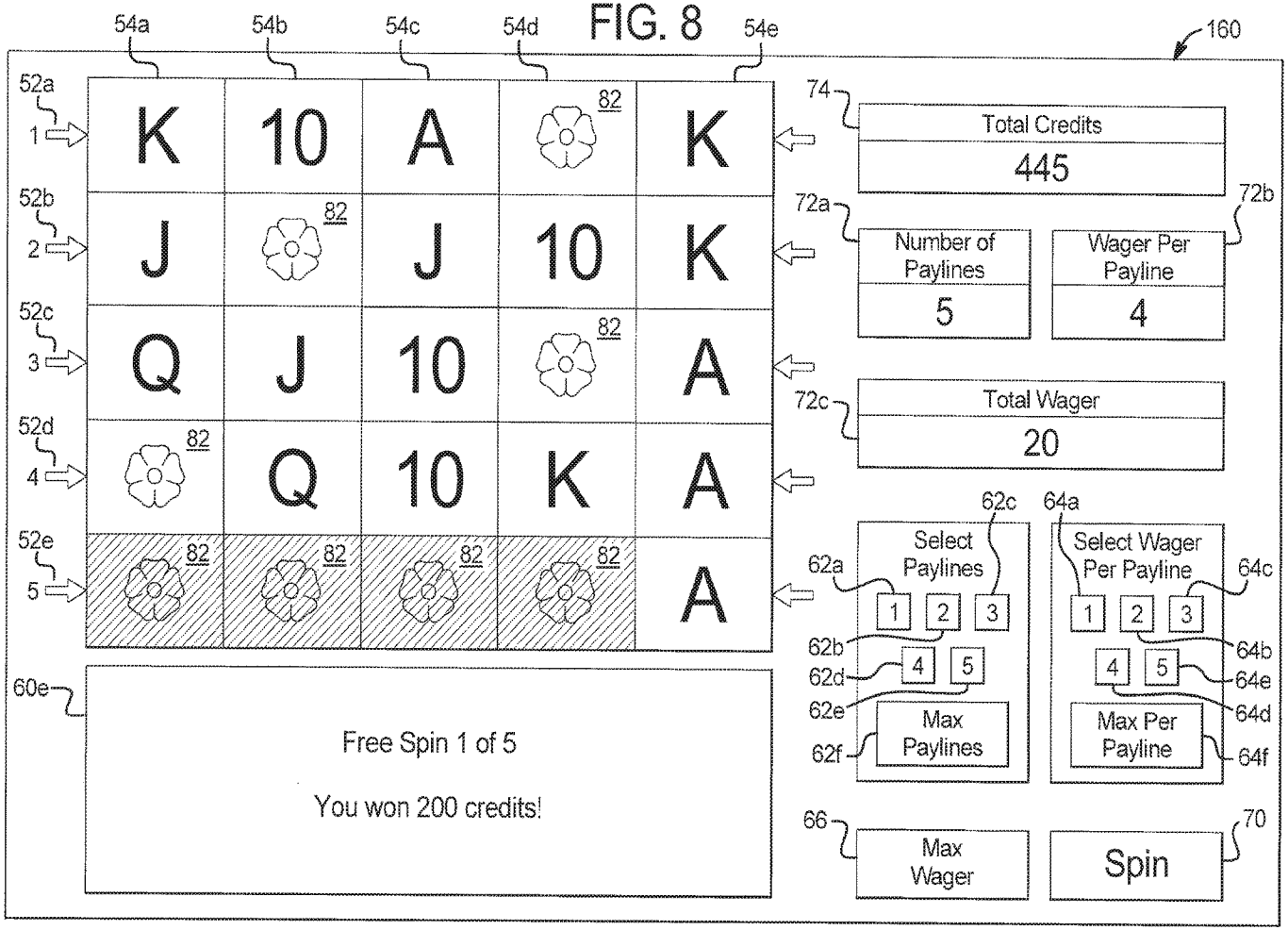

Referring now to FIG. 8, the gaming system randomly generates and displays an outcome of the first free play of the secondary game. That is, the gaming system generates and displays a plurality of the symbols of the modified reels. Message 60*e* informs the player that the gaming system is displaying the first one of the five free spins associated with option 120*a* selected by the player. In this example embodiment, the combination of four spring symbols 82 displayed on payline five 52*e* is a winning symbol combination. The gaming system provides an award of 200 credits to the player for the winning symbol combination. Accordingly, message 60*e* indicates the award to the player and the number of credits displayed by total credit meter 74 increases by 200 credits to 445 credits. Message 60*e* prompts the player to press spin button 70 to play the next free spin (i.e., the second free play of the secondary game).

For each of the remaining four free spins (i.e., plays of the secondary game) associated with the selected option 120*a*, the gaming system generates and displays an outcome of the free play of the secondary game and provides the player with any awards associated with the outcome of the free play of the secondary game. As illustrated in FIG. 9, the gaming system does not provide the player any awards for the second and third free spins. However, the gaming system provides an award of 100 credits to the player for the fourth free spin, and an award of 400 credits to the player for the fifth free spin. Therefore, the player won a total of 700 credits for the five free plays of the secondary game.

After the gaming system displays an outcome for each of the five free spins associated with the selected option 120*a*, the gaming system changes the symbols of modified reels 54 (i.e., the secondary set of symbols) back to the symbols of the reels used in the primary wagering game (i.e., the primary set of symbols). That is, the gaming system changes each spring symbol 82 used to replace one of the other major symbols 90 back to the major symbol 90 originally replaced. For example, if the gaming system replaced a summer symbol 84 with a spring symbol 82 for the five free plays of the secondary game, the gaming system replaces the spring symbol 82 with the summer symbol 84 after the gaming system displays an outcome for each of the five free plays of the secondary game. The gaming system enables the player to place a wager for another play of the primary wagering game. The symbols of the reels used for any subsequent play of the primary wagering game are the same as the symbols of the reels used for the first play of the primary wagering game regardless of whether the gaming system modified the symbols of the reels for plays of the secondary game. Thus, it should be appreciated that by varying the number of plays of the secondary game associated with each player selectable option, and by varying the symbol functionality associated with each option, the gaming system disclosed herein enables players to select a volatility from a plurality of options for use in a free activation bonus sequence.

It should be appreciated that various embodiments of the gaming system associate the player selectable options with different pools of symbols or different symbol functionality. In one embodiment, the primary set of symbols includes a plurality of sub-sets of symbols. For a play of the primary wagering game, the gaming system randomly generates and displays a plurality of symbols from the primary set of symbols, and provides the player with any awards associated with the outcome of the play of the primary wagering game. Upon a triggering event in the primary wagering game, the gaming system enables the player to select one of a plurality of options. Each of the options is associated with a different number of plays of a secondary game and a different one of the sub-sets of symbols. After the player selects one of the options, for each of the number of plays of the secondary game associated with the selected option, the gaming system generates and displays a plurality of symbols from the primary set of symbols. Instead of providing the player with an award for any generated and displayed symbols of the primary set of symbols, the gaming system forms a secondary set of generated and displayed symbols by replacing each symbol of the sub-set of symbols associated with the selected option with a designated symbol. The gaming system determines if the generated and displayed symbols of the secondary set of generated and displayed symbols form any winning symbol combinations, and provides the player with any awards associated with the generated and displayed winning symbol combinations.

Figure 10:
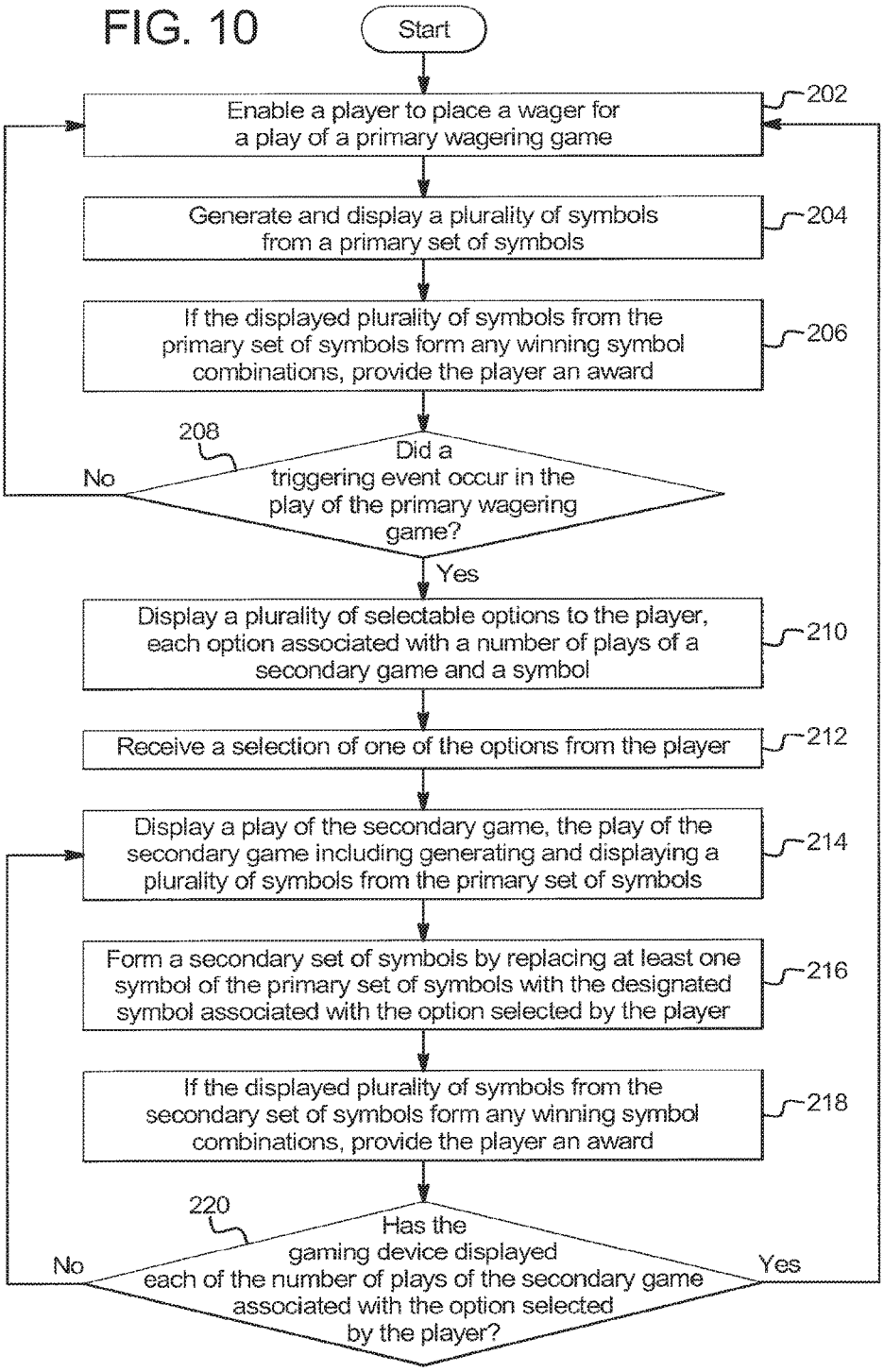
FIG. 10 is a flow chart illustrating operation of an alternative embodiment of the gaming system disclosed herein.

For example, in one embodiment, the gaming system enables a player to place a wager for a play of a primary wagering game as indicated by block 202 of FIG. 10. After the player places the wager for the play of the primary wagering game, the gaming system generates and displays a plurality of symbols from the primary set of symbols as indicated by block 204. The primary set of symbols includes a plurality of sub-sets of symbols. As indicated by block 206, if the generated and displayed symbols form any winning symbol combinations, the gaming system provides the player with an award associated with the generated and displayed winning symbol combinations.

After the gaming system provides the player with any awards for the play of the primary wagering game, the gaming system determines if a triggering event occurred in the play of the primary wagering game as indicated by block 208. If a triggering event did not occur in the play of the primary wagering game, the gaming system enables the player to place a wager for another play of the primary wagering game and repeats the steps indicated by blocks 202 through 208. If the triggering event did occur in the play of the primary game, the gaming system displays a plurality of selectable options to the player as indicated by block 210. Each of the selectable options is associated with a number of plays of a secondary game and one of the sub-sets of symbols.

Upon receipt of a selection by the player of one of the options as indicated by block 212, the gaming system generates and displays a plurality of symbols from the primary set of symbols for a play of a secondary game as indicated by block 214. After the gaming system generates and displays the plurality of symbols of the primary set of symbols, the gaming system forms a secondary set of symbols by replacing one of the sub-sets of symbols with the designated symbol associated with the option selected by the player as indicated by block 216. As indicated by block 218, if the generated and displayed symbols form any winning symbol combinations, the gaming system provides the player with an award associated with the generated and displayed winning symbol combinations. As indicated by block 220, the gaming system determines if an outcome for each of the number of plays of the secondary game associated with the option selected by the player has been displayed. If not, the gaming system repeats the steps illustrated by blocks 214 through 220 until an outcome for each of the number of plays of the secondary game associated with the option selected by the player has been played. If an outcome has been displayed for each of the number of plays of the secondary game associated with the option selected by the player, the gaming system enables the player to place a wager for another play of the primary wagering game as indicated by block 202.

Figure 11:
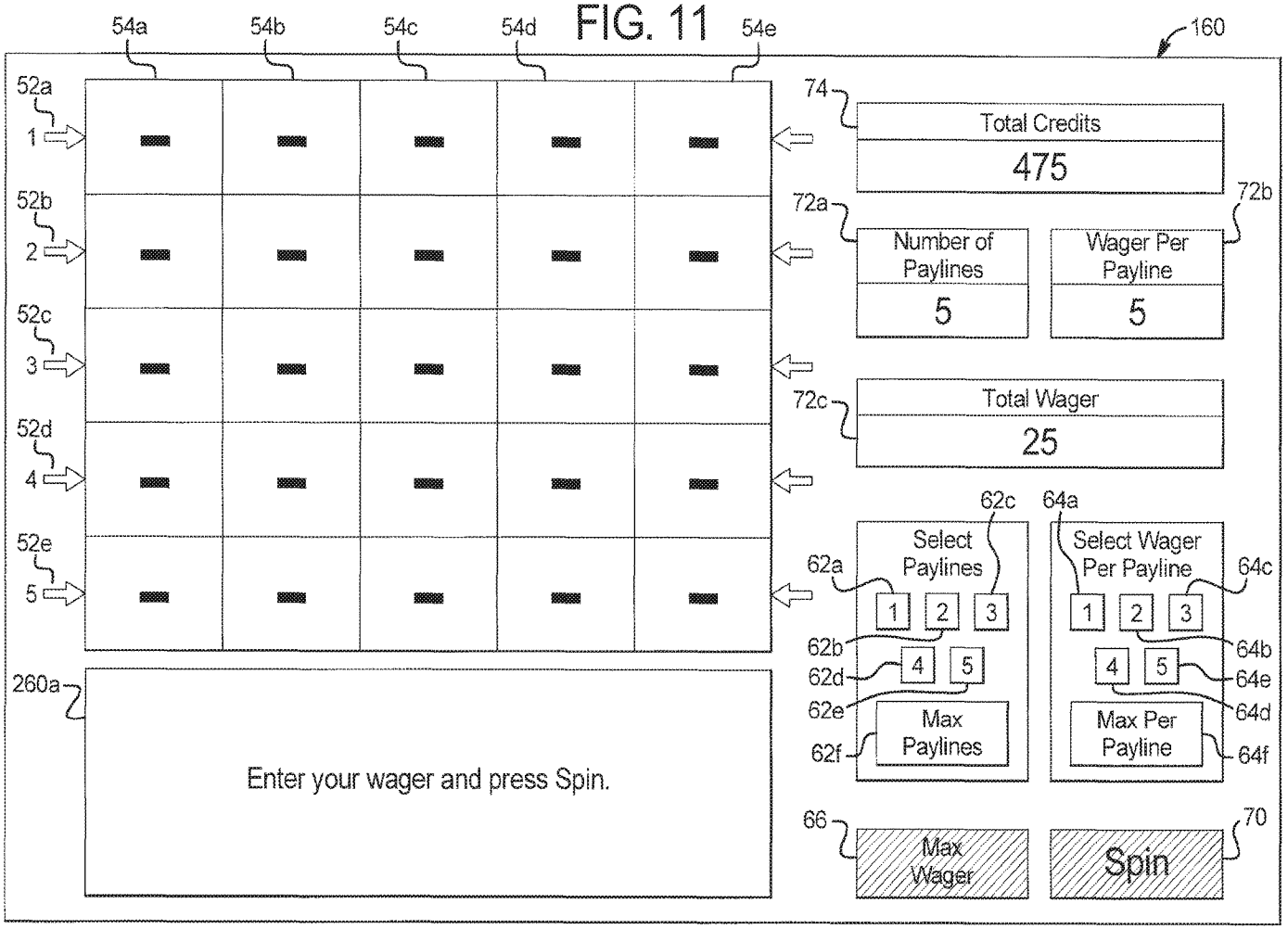
FIGS. 11, 12, 13, 14, 15, and 16 are enlarged views of one of the displays of an example of the embodiment of FIG. 10, and illustrate an example of the operation of the embodiment of FIG. 10.

An example of the operation of the embodiment of FIG. 10 is illustrated in FIG. 11 through FIG. 17. Referring now to FIG. 11, message 260*a* prompts the player to enter a wager for a play of the primary wagering game. The player uses max wager button 66 to enter a wager of five credits on each one of five paylines for a total wager of 25 credits for the play of the primary wagering game. The player uses spin button 70 to play the play of the primary wagering game.

Figure 12:
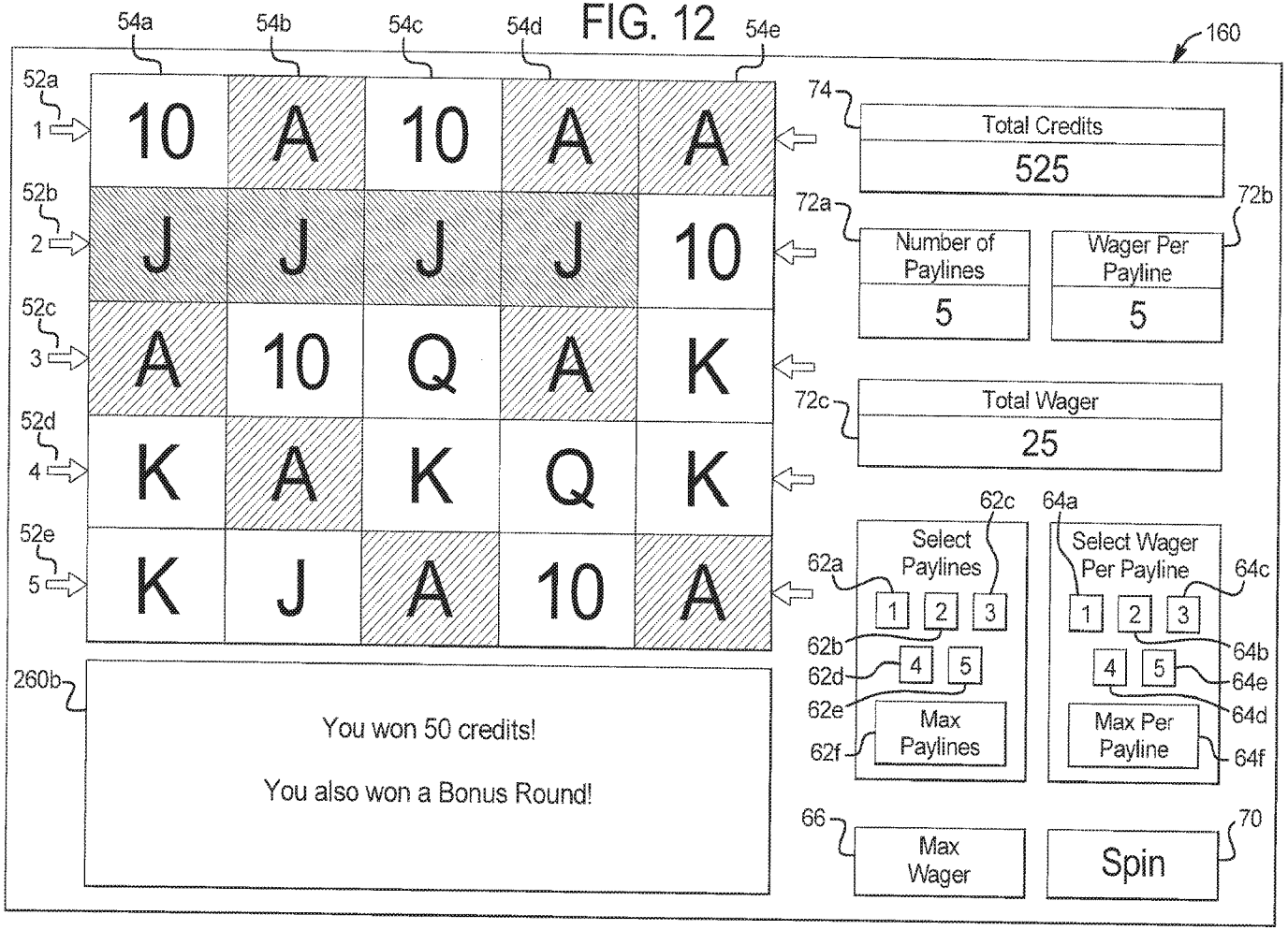

Referring now to FIG. 12, the gaming system generates and displays an outcome for the play of the primary wagering game. That is, the gaming system randomly generates and displays a plurality of symbols of the primary set of symbols. The primary set of symbols includes a plurality of sub-sets of symbols. For example, in this embodiment, the "10" symbols, "J" symbols, "Q" symbols, "K" symbols, and "A" symbols each form a different sub-set of symbols. As illustrated in FIG. 12, the combination of four "J" symbols on payline two 52*b* is a winning symbol combination. The gaming system provides the player with the award of 50 credits associated with the winning symbol combination. Accordingly, the gaming system displays message 260*b* to indicate the award to the player, and the number of credits displayed by total credit meter 74 increases by 50 credits to 525 credits.

Figure 13:
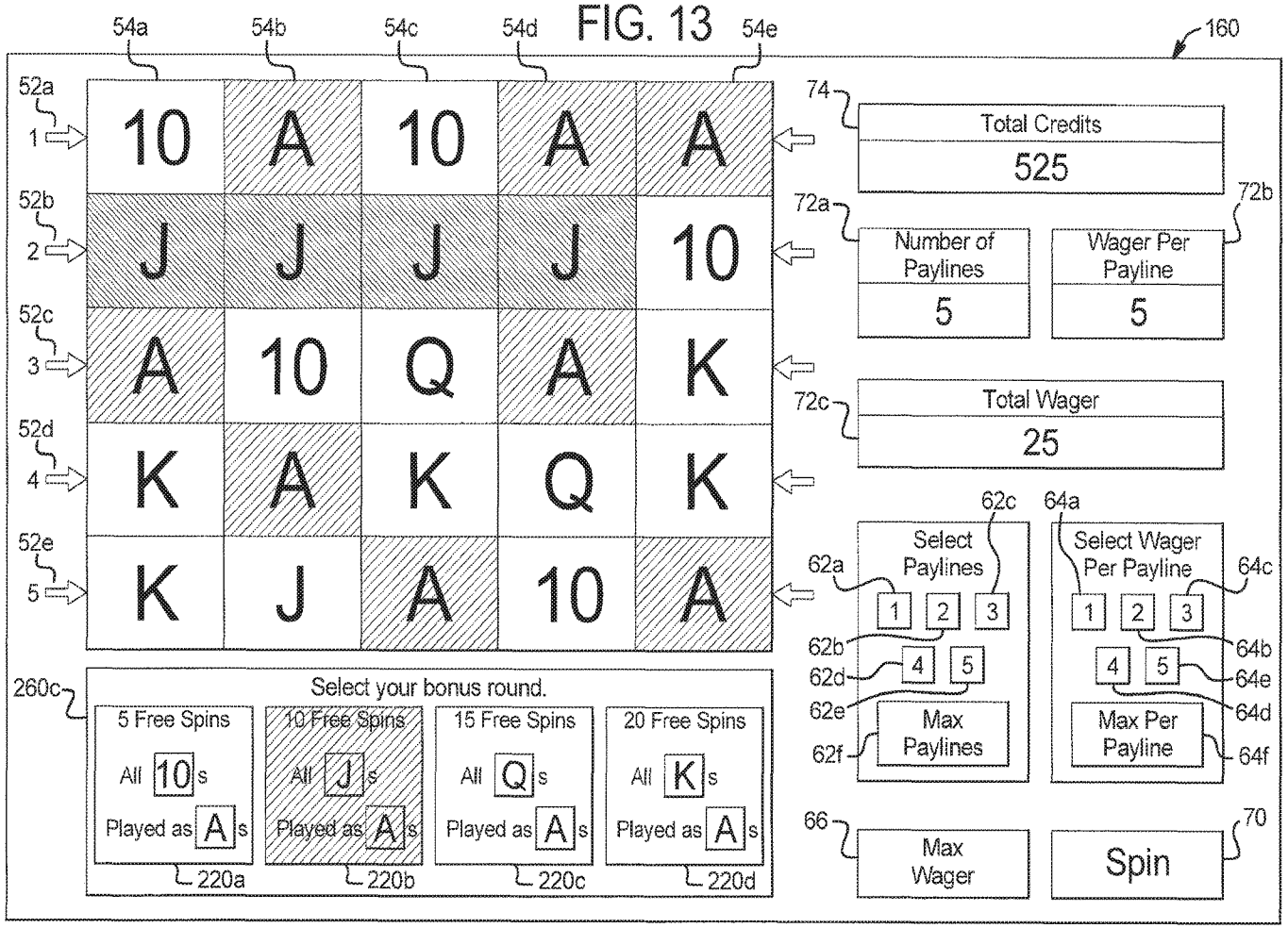

Additionally, the eight scattered "A" symbols generated and displayed for the play of the primary wagering game is a triggering event which causes the gaming system to provide the player with a free activation bonus sequence. As illustrated in FIG. 13, as a result of the triggering event, the gaming system enables the player to select one of a plurality of displayed options 220. Each displayed option 220 indicates that the player's selection of the option causes the gaming system to provide the player with a number of free spins of reels 54 played with each symbol of one of the sub-sets of symbols changed to a designated symbol. In this example embodiment, as illustrated in FIG. 13, if the player selects option 220*b*, for each of the ten free spins of reels 54 (i.e., for each free play of the secondary game), the gaming system generates and displays a plurality of symbols of the primary set of symbols. After the gaming system generates and displays the plurality of symbols of the primary set of symbols, the gaming system replaces each generated and displayed "J" symbol with an "A" symbol. That is, the gaming system replaces each symbol of the sub-set of "J" symbols with an "A" symbol. The gaming system then determines if any winning symbols combinations are generated and displayed, and provides the player with any award associated with any generated and displayed winning symbol combinations after the gaming system replaces the "J" symbols with the "A" symbols.

Figure 14:
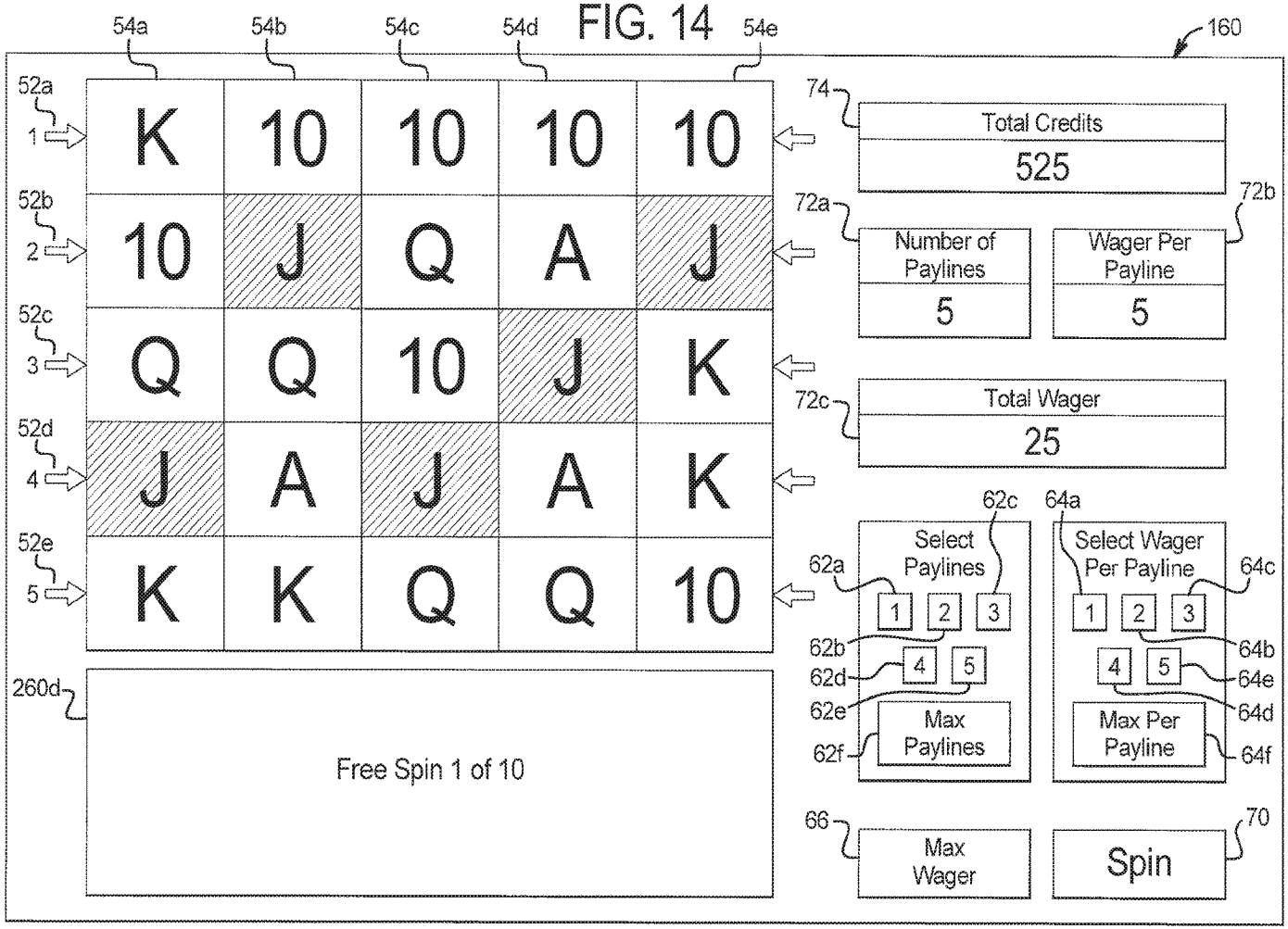
Figure 15:
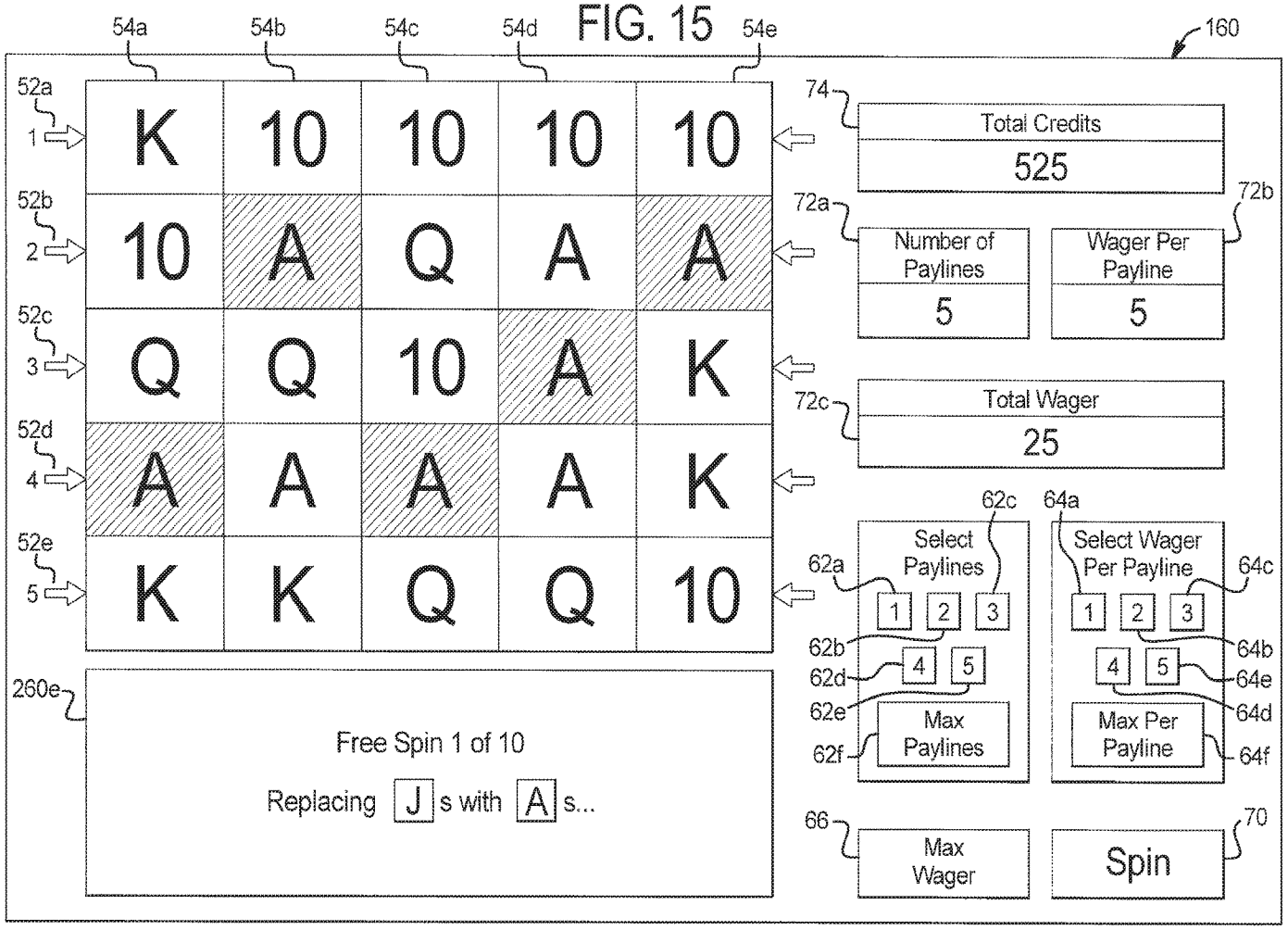

As shown in FIG. 13, the player selects option 220*b*. Referring now to FIG. 14, in this example embodiment, the gaming system generates and displays a plurality of symbols of reels 54 (i.e., a plurality of symbols of the primary set of symbols). The gaming system generated and displayed five "J" symbols for this play of the secondary game. As illustrated by FIG. 15, after the gaming system generates and displays a plurality of symbols of the primary set of symbols, the gaming system forms a secondary set of generated and displayed symbols by replacing each of the generated and displayed "J" symbols of the primary set of symbols with an "A" symbol. Message 260*e* informs the player that the gaming system is replacing the "J" symbols with "A" symbols.

Figure 16:
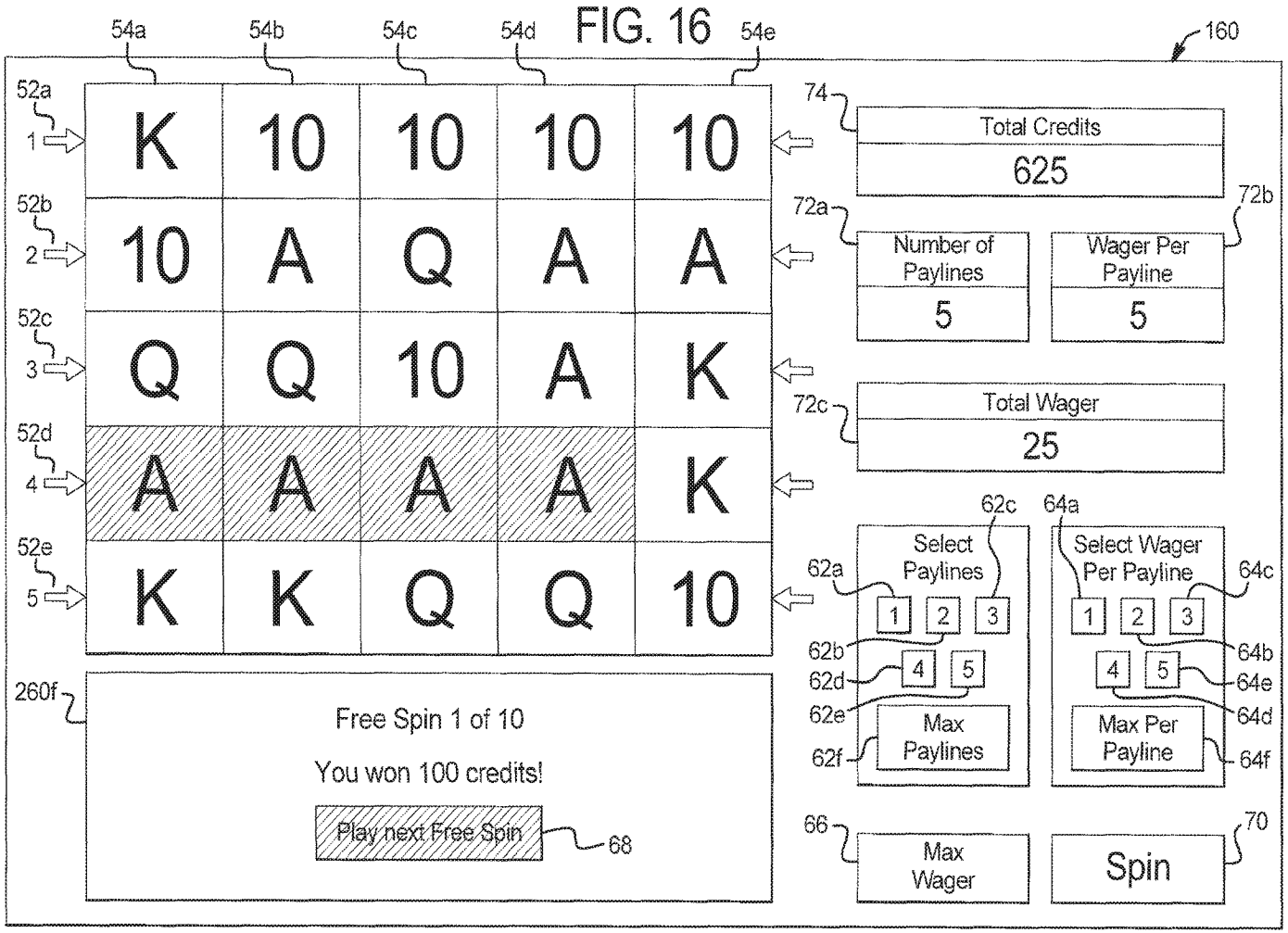

Referring now to FIG. 16, after the gaming system replaces the "J" symbols with the "A" symbols, the gaming system determines if any winning symbol combinations are generated and displayed. The combination of four "A" symbols on payline 52*d* is a winning symbol combination. The gaming system provides the player with an award of 100 credits for the winning symbol combination and total credit meter 74 increases by 100 credits to 625 credits. The player uses play next free spin button 68 to play the next free play of the secondary game. As illustrated by FIG. 17, the player plays each of the remaining free plays of the secondary game and wins a total of 350 credits for the ten free spins (i.e., the ten free plays of the wagering game) associated with option 120*b*. Thus, even though the gaming system uses the same designated symbol (i.e., the "A" symbol) to replace one or more symbols of the reels regardless of the option selected by the player, by varying which symbol or symbols of the reels (i.e., the "10" symbols, the "J" symbols, etc.) the gaming system replaces with the designated symbol, and by varying the number of plays of the secondary game associated with each option, the gaming system enables the player to select a volatility from a plurality of different options for use in the bonus activation sequence. It should be appreciated that in various embodiments, the secondary game is presented as a plurality of free spins or free plays of the primary wagering game.

In various embodiments, the number of plays of the secondary game (i.e., the number of free spins) associated with each option and the pool of symbols or symbol functionality associated with each option vary. For example, in one embodiment, the gaming system replaces ten symbols of the primary set of symbols with "A" symbols and provides the player with five free plays of the secondary game if the player selects a first option. If the player selects a second option, the gaming system replaces ten symbols of the primary set of symbols with "K" symbols and provides the player with ten free plays of the secondary game. Although the number of symbols the gaming system replaces is the same for each option, the probability of achieving winning symbol combinations which include "A" symbols in the plays of the secondary game may be different from the probability of achieving winning symbol combinations which include "K" symbols in the plays of the secondary game.

For example, in one embodiment, the primary set of symbols includes twenty "K" symbols and only five "A" symbols. If the gaming system replaces ten "J" symbols of the primary set of symbols with "K" symbols, the modified set of symbols includes thirty "K" symbols. In contrast, if the gaming system replaces ten "J" symbols of the primary set of symbols with "A" symbols, the modified set of symbols includes fifteen "A" symbols. Thus, in this example, the probability of achieving winning symbol combinations which include "K" symbols in the plays of the secondary game is greater than the probability of achieving winning symbol combinations which include "A" symbols in the plays of the secondary game. However, in this example, if the gaming system replaces ten "J" symbols with "A" symbols, the number of "A" symbols in the modified set of symbols increases three times compared with the number of "A" symbols in the primary set of symbols. If the gaming system replaces ten "J" symbols with "K" symbols, the number of "K" symbols in the modified set of symbols increases by only fifty percent compared with the number of "K" symbols in the primary set of symbols. Thus, the difference between the probability of achieving winning symbol combinations which include "A" symbols in plays of the primary wagering game and the probability of achieving winning symbol combinations which include "A" symbols in the plays of the secondary game is greater than the difference between the probability of achieving winning symbol combinations which include "K" symbols in plays of the primary wagering game and the probability of achieving winning symbol combinations which include "K" symbols in the plays of the secondary game.

Additionally, the average award per occurrence of winning symbol combinations which include "A" symbols may be different from the average award per occurrence of winning symbol combinations which include "K" symbols. For example, in one embodiment, the gaming system provides the player with an award of 100 credits for the winning symbol combination of three "A" symbols, 250 credits for the winning symbol combination of four "A" symbols, and 1000 credits for the winning symbol combination of five "A" symbols. Similarly, the gaming system provides the player with an award of 50 credits for the winning symbol combination of three "K" symbols, 200 credits for the winning symbol combination of four "K" symbols, and 500 credits for the winning symbol combination of five "K" symbols. Thus, the average expected payout per occurrence of winning symbol combinations which include "A" symbols is 450 credits, while the average expected payout per occurrence of winning symbol combinations which include "K" symbols is only 250 credits. Additionally, the highest award achievable for winning symbol combinations which include "A" symbols is 1000 credits, while the highest award achievable for winning symbol combinations which include "K" symbols is only 500 credits. It should be appreciated that the average expected award per occurrence of winning symbol combinations which include a particular symbol and the maximum and minimum awards for winning symbol combinations which include the particular symbol may vary. It should also be appreciated that while the maximum award for winning symbol combinations which include a first symbol associated with one of the plurality of options may be higher than the maximum award for winning symbol combinations which include a different second symbol associated with a different one of the plurality of options, the average expected payout per occurrence of winning symbol combinations which include the first symbol may be lower than the average expected award per occurrence of winning symbol combinations which include the second symbol.

In various alternative embodiments, the number of symbols the gaming system replaces if the player selects a first option is different from the number of symbols the gaming system replaces if the player selects a second different option. For example, in one embodiment, the gaming system replaces ten symbols of the primary set of symbols with "A" symbols and provides the player with five free plays of the secondary game if the player selects a first option. If the player selects a second option, the gaming system replaces only five symbols of the primary set of symbols with "A" symbols and provides the player with ten free plays of the secondary game. Since the gaming system forms a secondary set of symbols which includes more "A" symbols if the player selects the first option than if the player selects the second option, the probability of achieving winning symbol combinations which include "A" symbols is greater for the first option than for the second option. It should be appreciated that instead of replacing one or more of the symbols of the primary set of symbols to form the secondary set of symbols, the gaming system may add an additional one or more symbols to the primary set of symbols to form the secondary set of symbols.

In one embodiment, each option is associated with a plurality of symbols and/or sub-sets of symbols, and the gaming system replaces a designated number of symbols of the primary set of symbols with one or more of the plurality of symbols associated with the selected option to form the secondary set of symbols. In another embodiment, each option is associated with one or more symbols, and the gaming system replaces each symbol of a sub-set of symbols of the primary set of symbols with one or more of the symbols associated with the selected option. It should be appreciated that if the selected option is associated with more than one symbol, the gaming system may randomly determine which of the symbols to use to replace one or more of the symbols of the primary set of symbols. Alternatively, the gaming system may use a predetermined number of each of the symbols to replace one or more of the symbols of the primary set of symbols. For example, in one embodiment, if the player selects a designated option, the gaming system replaces each of a number of symbols of the primary set of symbols with one of: (a) an "A" symbol, and (b) a "10" symbol. The gaming system may randomly determine which of the "A" symbol and the "10" symbol to use to replace each of the number of symbols of the primary set of symbols.

In various embodiments, each option is associated with a plurality of different types of symbols and/or sub-sets of symbols and the same number of plays of the secondary game. For example, in one embodiment, a first option is associated with an "A" symbol and a "10" symbol and five free plays of the secondary game. A second option is associated with a "J" symbol and a "K" symbol. The probability of achieving winning symbol combinations which include "A" symbols may be the same or different from the probability of achieving winning symbol combinations which include "10" symbols. Additionally, the average award per occurrence of winning symbol combinations which include "A" symbols may be the same or different from the average award per occurrence of winning symbol combinations which include "10" symbols.

In one embodiment, the gaming system randomly determines which symbols of the primary set of symbols to replace with the symbol associated with the selected option. In another embodiment, the symbols of the primary set of symbols replaced by the symbol associated with the selected option are predetermined. In various embodiments, the gaming system may randomly determine which symbols of a sub-set of symbols of the primary set of symbols to replace with the symbol associated with the selected option.

In one embodiment, instead of replacing one or more of the symbols of the primary set of symbols to form the secondary set of symbols, the gaming system adds an additional one or more symbols to the primary set of symbols to form the secondary set of symbols. In another embodiment, the secondary set of symbols includes fewer different types or fewer different sub-sets of symbols than the primary set of symbols, regardless of whether the total number of symbols of the secondary set of symbols is the same or different from the total number of symbols of the primary set of symbols. In various alternative embodiments, the primary set of symbols and the secondary set of symbols include different symbols, different types of symbols, different numbers of symbols, and/or different numbers of types of symbols.

In one embodiment, the symbols associated with at least one of the options are determined from the symbols of the primary set of symbols. The symbols associated with the at least one option may be randomly determined, predetermined, and/or based on the outcome of the primary game. Alternatively, the gaming system may enable the player to select one or more of the symbols to associate with the at least one option.

In various alternative embodiments, one or more of the options is associated with a wild symbol. After the player selects one of the options, the gaming system modifies the primary set of symbols to form the secondary set of symbols by replacing one or more of the symbols of the primary set of symbols with the wild symbol associated with the selected option. The wild symbol may form winning symbol combinations with one or more other wild symbols, one or more types of symbols, one or more symbols of one or more sub-sets of symbols, or one or more of any of the symbols.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A dedicated electronic gaming machine comprising:
a housing;
at least one display device supported by the housing;
a payment acceptor supported by the housing;
at least one input device supported by the housing;
an application-specific integrated circuit comprising:
a first set of instructions that, when executed following receipt of a physical item by the payment acceptor, cause the application-specific integrated circuit to establish a credit balance based at least in part on a monetary value associated with the physical item wherein the physical item is selected from the group consisting of: a ticket associated with the monetary value and a unit of currency;
a second set of instructions that, when executed following receipt of an actuation of a wager button to place a wager for a play of a primary game associated with a primary symbol set of a plurality of symbols, cause the application-specific integrated circuit to:
decrease the credit balance by the placed wager; and
for the play of the primary game:
randomly determine a plurality of the symbols of the primary symbol set,
cause the at least one display device to display the randomly determined plurality of symbols of the primary symbol set,
determine any primary awards based on the displayed symbols of the primary symbol set, and cause the at least one display device to display any determined primary awards, the credit balance increasable by any determined primary awards;

a third set of instructions that, when executed responsive to a triggering event occurring, cause the application-specific integrated circuit to:

cause the at least one display device to display a plurality of different selectable options including:

a first option associated with a first quantity of plays of a secondary game and a first secondary symbol set of a plurality of symbols, the plurality of symbols of the first secondary symbol set including a first quantity of instances of a designated symbol; and a second option associated with a second quantity of plays of a secondary game and a second secondary symbol set of a plurality of symbols, the plurality of symbols of the second secondary symbol set including a second quantity of instances of a designated symbol, the second quantity of plays of the secondary game being greater than the first quantity of plays of the secondary game and the second quantity of instances of the designated symbol being less than the first quantity of instances of the designated symbol; and set a player selectable volatility of the secondary game by:

responsive to a selection of the first option being received via the at least one input device, for at least one of the first quantity of plays of the secondary game:

randomly determine a plurality of the symbols of the first secondary symbol set, cause the at least one display device to display the randomly determined plurality of the symbols of the first secondary symbol set, determine any secondary awards associated with the displayed symbols of the first secondary symbol set, and cause the at least one display device to display any determined secondary awards, the credit balance being increasable by any determined secondary awards;

responsive to a selection of the second option being received via the at least one input device, for at least one of the second quantity of plays of the secondary game:

randomly determine a plurality of the symbols of the second secondary symbol set, cause the at least one display device to display the randomly determined plurality of the symbols of the second secondary symbol set, determine any secondary awards associated with the displayed symbols of the second secondary symbol set, and cause the at least one display device to display any determined secondary awards, the credit balance being increasable by any determined secondary awards; and a fourth set of instructions that, when executed following receipt of an actuation of a cashout button, cause the application-specific integrated circuit to initiate a payout associated with the credit balance.

2. The dedicated electronic gaming machine of claim 1, wherein the designated symbol is a wild symbol.

3. The dedicated electronic gaming machine of claim 1, wherein at least one instance of the designated symbol is included in the primary symbol set.

4. The dedicated electronic gaming machine of claim 1, wherein when executed, the third set of instructions cause the application-specific integrated circuit to form the first secondary symbol set by adding the first quantity of instances of the designated symbol to the primary symbol set.

5. The dedicated electronic gaming machine of claim 4, wherein each instance of the designated symbol added to the primary symbol set replaces an instance of another symbol of the primary symbol set.

6. The dedicated electronic gaming machine of claim 1, wherein when executed, the third set of instructions cause the application-specific integrated circuit to form the second secondary symbol set by adding the second quantity of instances of the designated symbol to the primary symbol set.

7. The dedicated electronic gaming machine of claim 6, wherein each instance of the designated symbol added to the primary symbol set replaces an instance of another symbol of the primary symbol set.

8. The dedicated electronic gaming machine of claim 1, wherein the options include a third option associated with a third quantity of plays of a secondary game and a third secondary symbol set of a plurality of symbols, the plurality of symbols of the third secondary symbol set including a third quantity of instances of a designated symbol, the third quantity of plays of the secondary game being greater than the second quantity of plays of the secondary game and the third quantity of instances of the designated symbol being less than the second quantity of instances of the designated symbol, and wherein when executed responsive to a selection of the third option being received, the third set of instructions cause the application-specific integrated circuit to, for at least one of the third quantity of plays of the secondary game:

randomly determine a plurality of the symbols of the third secondary symbol set, cause the at least one display device to display the randomly determined plurality of the symbols of the third secondary symbol set, determine any secondary awards associated with the displayed symbols of the third secondary symbol set, and cause the at least one display device to display any determined secondary awards, the credit balance being increasable by any determined secondary awards.

9. The dedicated electronic gaming machine of claim 8, wherein the designated symbol is a wild symbol.

10. A method of operating a dedicated electronic gaming system, the method comprising:

receiving, by a payment acceptor, a physical item associated with a monetary value, wherein the physical item is selected from the group consisting of: a ticket associated with the monetary value and a unit of currency;

establishing, by a dedicated electronic gaming machine application-specific integrated circuit, a credit balance based at least in part on the monetary value associated with the received physical item;

receiving an actuation of a wager button;

placing, by the dedicated electronic gaming machine application-specific integrated circuit, a wager for a play of a primary game responsive to the actuation of the wager button, the primary game associated with a primary symbol set of a plurality of symbols, the credit balance being decreasable by the wager;

for the play of the primary game:

randomly determining, by the dedicated electronic gaming machine application-specific integrated circuit, and displaying, by at least one display device, a plurality of the symbols of the primary symbol set, determining, by the dedicated electronic gaming machine application-specific integrated circuit, any primary awards based on the displayed symbols of the primary symbol set, and displaying, by the at least one display device, any determined primary awards, the credit balance increasable by any determined primary awards;

responsive to a triggering event occurring:

displaying, by the at least one display device, a plurality of different selectable options including:

a first option associated with a first quantity of plays of a secondary game and a first secondary symbol set of a plurality of symbols, the plurality of symbols of the first secondary symbol set including a first quantity of instances of a designated symbol; and a second option associated with a second quantity of plays of a secondary game and a second secondary symbol set of a plurality of symbols, the plurality of symbols of the second secondary symbol set including a second quantity of instances of a designated symbol, the second quantity of plays of the secondary game being greater than the first quantity of plays of the secondary game and the second quantity of instances of the designated symbol being less than the first quantity of instances of the designated symbol; and setting a player selectable volatility of the secondary game by:

responsive to a selection of the first option being received, for at least one of the first quantity of plays of the secondary game:

randomly determining, by the dedicated electronic gaming machine application-specific integrated circuit, and displaying, by at least one display device, a plurality of the symbols of the first secondary symbol set, determining, by the dedicated electronic gaming machine application-specific integrated circuit, any secondary awards associated with the displayed symbols of the first secondary symbol set, and displaying, by the at least one display device, any determined secondary awards, the credit balance being increasable by any determined secondary awards;

responsive to a selection of the second option being received, for at least one of the second quantity of plays of the secondary game:

randomly determining, by the dedicated electronic gaming machine application-specific integrated circuit, and displaying, by at least one display device, a plurality of the symbols of the second secondary symbol set, determining, by the dedicated electronic gaming machine application-specific integrated circuit, any secondary awards associated with the displayed symbols of the second secondary symbol set, and displaying, by the at least one display device, any determined secondary awards, the credit balance being increasable by any determined secondary awards;

receiving an actuation of a cashout button; and initiating, by the dedicated electronic gaming machine application-specific integrated circuit, a payout associated with the credit balance responsive to the actuation of the cashout button.

11. The method of claim 10, wherein the designated symbol is a wild symbol.

12. The method of claim 10, wherein at least one instance of the designated symbol is included in the primary symbol set.

13. The method of claim 10, further comprising forming, by the dedicated electronic gaming machine application-specific integrated circuit, the first secondary symbol set by adding the first quantity of instances of the designated symbol to the primary symbol set.

14. The method of claim 13, wherein each instance of the designated symbol added to the primary symbol set replaces an instance of another symbol of the primary symbol set.

15. The method of claim 10, further comprising forming, by the dedicated electronic gaming machine application-specific integrated circuit, the second secondary symbol set by adding the second quantity of instances of the designated symbol to the primary symbol set.

16. The method of claim 15, wherein each instance of the designated symbol added to the primary symbol set replaces an instance of another symbol of the primary symbol set.

17. The method of claim 10, wherein the options include a third option associated with a third quantity of plays of a secondary game and a third secondary symbol set of a plurality of symbols, the plurality of symbols of the third secondary symbol set including a third quantity of instances of a designated symbol, the third quantity of plays of the secondary game being greater than the second quantity of plays of the secondary game and the third quantity of instances of the designated symbol being less than the second quantity of instances of the designated symbol, and further comprising, responsive to a selection of the third option being received, for at least one of the third quantity of plays of the secondary game:

randomly determining, by the dedicated electronic gaming machine application-specific integrated circuit, and displaying, by at least one display device, a plurality of the symbols of the third secondary symbol set, determining, by the dedicated electronic gaming machine application-specific integrated circuit, any secondary awards associated with the displayed symbols of the third secondary symbol set, and displaying, by the at least one display device, any determined secondary awards, the credit balance being increasable by any determined secondary awards.

18. The method of claim 17, wherein the designated symbol is a wild symbol.

19. The method of claim 10, which is at least partially provided through a data network.

20. The method of claim 19, wherein the data network is an internet.

21. A gaming system comprising:

a processor; and a memory device that stores a plurality of instructions that, when executed by the processor following a receipt of data associated with a credit balance established responsive to an electronic funds transfer initiated from a thin client device, cause the processor to:

for a play of a primary game associated with a primary symbol set of a plurality of symbols:

randomly determine a plurality of the symbols of the primary symbol set, communicate data which results in a display device of the thin client device displaying the randomly determined plurality of symbols of the primary symbol set, determine any primary awards based on the displayed symbols of the primary symbol set, and communicate data which results in the display device of the thin client device displaying any determined primary awards, the credit balance being increasable by any determined primary awards;

if a triggering event occurs:

communicate data which results in the display device of the thin client device displaying a plurality of different selectable options including:

a first option associated with a first quantity of plays of a secondary game and a first secondary symbol set of a plurality of symbols, the plurality of symbols of the first secondary symbol set including a first quantity of instances of a designated symbol; and a second option associated with a second quantity of plays of a secondary game and a second secondary symbol set of a plurality of symbols, the plurality of symbols of the second secondary symbol set including a second quantity of instances of a designated symbol, the second quantity of plays of the secondary game being greater than the first quantity of plays of the secondary game and the second quantity of instances of the designated symbol being less than the first quantity of instances of the designated symbol; and set a player selectable volatility of the secondary game by:

responsive to a selection of the first option being received, for at least one of the first quantity of plays of the secondary game:

randomly determine a plurality of the symbols of the first secondary symbol set, communicate data which results in the display device of the thin client device displaying the randomly determined plurality of the symbols of the first secondary symbol set, determine any secondary awards associated with the displayed symbols of the first secondary symbol set, and communicate data which results in the display device of the thin client device displaying any determined secondary awards, the credit balance being increasable by any determined secondary awards;

responsive to a selection of the second option being received via the at least one input device, for at least one of the second quantity of plays of the secondary game:

randomly determine a plurality of the symbols of the second secondary symbol set, communicate data which results in the display device of the thin client device displaying the randomly determined plurality of the symbols of the second secondary symbol set, determine any secondary awards associated with the displayed symbols of the second secondary symbol set, and communicate data which results in the display device of the thin client device displaying any determined secondary awards, the credit balance being increasable by any determined secondary awards.

22. The gaming system of claim 21, wherein the designated symbol is a wild symbol.

23. The gaming system of claim 21, wherein at least one instance of the designated symbol is included in the primary symbol set.

24. The gaming system of claim 21, wherein when executed by the processor, the plurality of instructions cause the processor to form the first secondary symbol set by adding the first quantity of instances of the designated symbol to the primary symbol set.

25. The gaming system of claim 24, wherein each instance of the designated symbol added to the primary symbol set replaces an instance of another symbol of the primary symbol set.

26. The gaming system of claim 21, wherein when executed by the processor, the plurality of instructions cause the processor to form the second secondary symbol set by adding the second quantity of instances of the designated symbol to the primary symbol set.

27. The gaming system of claim 26, wherein each instance of the designated symbol added to the primary symbol set replaces an instance of another symbol of the primary symbol set.

28. The gaming system of claim 21, wherein the options include a third option associated with a third quantity of plays of a secondary game and a third secondary symbol set of a plurality of symbols, the plurality of symbols of the third secondary symbol set including a third quantity of instances of a designated symbol, the third quantity of plays of the secondary game being greater than the second quantity of plays of the secondary game and the third quantity of instances of the designated symbol being less than the second quantity of instances of the designated symbol, and wherein when executed by the processor, responsive to a selection of the third option being received the plurality of instructions cause the processor to, for at least one of the third quantity of plays of the secondary game:

randomly determine a plurality of the symbols of the third secondary symbol set, communicate data which results in the display device of the thin client device displaying the randomly determined plurality of the symbols of the third secondary symbol set, determine any secondary awards associated with the displayed symbols of the third secondary symbol set, and communicate data which results in the display device of the thin client device displaying any determined secondary awards, the credit balance being increasable by any determined secondary awards.

29. The gaming system of claim 28, wherein the designated symbol is a wild symbol.

30. The gaming system of claim 21, wherein when executed by the processor, the plurality of instructions cause the processor to communicate with the thin client device via a wireless network.

31. The gaming system of claim 21, wherein the thin client device comprises a handheld device.

* * * * *